US010330100B2

(12) United States Patent
Huang et al.

(10) Patent No.: US 10,330,100 B2
(45) Date of Patent: Jun. 25, 2019

(54) PUMP, PUMP ASSEMBLY AND LIQUID COOLING SYSTEM

(71) Applicant: COOLER MASTER CO., LTD., New Taipei (TW)

(72) Inventors: Shih-Wei Huang, New Taipei (TW); Shui-Fa Tsai, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 184 days.

(21) Appl. No.: 15/286,535

(22) Filed: Oct. 5, 2016

(65) Prior Publication Data

US 2018/0094633 A1 Apr. 5, 2018

(51) Int. Cl.

| | |
|---|---|
| ***F04D 13/14*** | (2006.01) |
| ***F04D 29/42*** | (2006.01) |
| ***F28F 13/06*** | (2006.01) |
| ***F04D 13/12*** | (2006.01) |
| ***F04B 23/04*** | (2006.01) |
| ***F04D 29/60*** | (2006.01) |
| ***F04D 13/06*** | (2006.01) |

(52) U.S. Cl.

CPC ..... *F04D 13/14* (2013.01); *F04B 23/04* (2013.01); *F04D 13/0693* (2013.01); *F04D 13/12* (2013.01); *F04D 29/605* (2013.01); *F28F 13/06* (2013.01); *F28F 2250/08* (2013.01)

(58) Field of Classification Search

CPC ..... F04B 23/04; F04D 13/0693; F04D 13/14; F04D 29/605; F28F 2250/08

See application file for complete search history.

(56) References Cited

U.S. PATENT DOCUMENTS

| | | | | |
|---|---|---|---|---|
| 2,165,626 | A | 7/1939 | Ford | |
| 5,186,480 | A * | 2/1993 | Morgan | A61G 5/08 280/250.1 |
| 5,269,811 | A | 12/1993 | Hayes | |
| 6,598,908 | B1 * | 7/2003 | Wosik | F16L 19/055 285/332.3 |
| 8,123,496 | B2 | 2/2012 | Ishii | |
| 2007/0000947 | A1 * | 1/2007 | Lewis | B01F 13/1055 222/132 |

(Continued)

FOREIGN PATENT DOCUMENTS

| | | | |
|---|---|---|---|
| CN | 2914327 | Y | 6/2007 |
| CN | 103907410 | A | 7/2014 |

(Continued)

OTHER PUBLICATIONS

English translation of EP 1085206.*

*Primary Examiner* — Dominick L Plakkoottam

(74) *Attorney, Agent, or Firm* — Locke Lord LLP; Tim Tingkang Xia, Esq.

(57) ABSTRACT

A pump assembly includes a plurality of pumps. Each of the pumps includes a pump body, a first opening, a second opening, a first connecting member and a second connecting member. The first opening and the second opening are located at a periphery of the pump body. The first connecting member is disposed on the first opening and the second connecting member is disposed on the second opening. The first connecting member of one of the pumps is detachably connected to the second connecting member of another of the pumps, such that each of the pumps can be connected to any of the pumps.

26 Claims, 21 Drawing Sheets

(56) References Cited

U.S. PATENT DOCUMENTS

| | | | | |
|---|---|---|---|---|
| 2007/0128048 | A1 | 6/2007 | Gonnella | |
| 2011/0313576 | A1* | 12/2011 | Nicewonger | F28D 15/00 700/282 |
| 2013/0213605 | A1* | 8/2013 | Shi | F28F 9/00 165/96 |
| 2013/0333865 | A1 | 12/2013 | Goth | |

FOREIGN PATENT DOCUMENTS

| | | | | |
|---|---|---|---|---|
| DE | 2421383 | * | 11/1975 | |
| DE | 10 2012 104 311 | A1 | 11/2013 | |
| EP | 1 085 206 | A1 | 3/2001 | |
| EP | 1085206 | A1 * | 3/2001 | F04B 17/04 |
| EP | 2 712 599 | A1 | 4/2014 | |
| TW | 201134375 | A1 | 10/2011 | |
| TW | 201215453 | A1 | 4/2012 | |
| TW | 201231102 | A1 | 8/2012 | |
| TW | 201302517 | A1 | 1/2013 | |
| WO | 9930918 | A1 | 6/1999 | |

* cited by examiner

PUMP, PUMP ASSEMBLY AND LIQUID COOLING SYSTEM

BACKGROUND OF THE INVENTION

1. Field of the Invention

The invention relates to a pump, a pump assembly and a liquid cooling system and, more particularly, to a pump capable of being attached to or detached from another pump or an external device.

2. Description of the Prior Art

In general, a liquid cooling system essentially consists of a liquid cooling head, a radiator, a pump and a liquid storage box connected through a plurality of tubes. When the liquid cooling system is dissipating heat from an electronic component, the pump transports a cooling liquid to the liquid cooling head, the cooling liquid absorbs the heat generated by the electronic component, and then the radiator cools the cooling liquid. Accordingly, a flow rate outputted by the pump will influence the efficiency of the liquid cooling system as a whole. So far the flow rate outputted by one single pump has a maximum limitation. To enhance the efficiency of the liquid cooling system, the pump used currently has to be replaced by another pump with larger flow rate. Therefore, the pump of the prior art is not flexible in use and the cost of setting up the liquid cooling system may increase.

SUMMARY OF THE INVENTION

The invention provides a pump capable of being attached to or detached from another pump or an external device and further provides a pump assembly and a liquid cooling system equipped with the pump, so as to solve the aforesaid problems.

According to an embodiment of the invention, a pump assembly comprises a plurality of pumps, wherein each of the pumps comprises a pump body, a first opening, a second opening, a first connecting member and a second connecting member. The first opening and the second opening are located at a periphery of the pump body. The first connecting member is disposed on the first opening and the second connecting member is disposed on the second opening. The first connecting member of one of the pumps is detachably connected to the second connecting member of another of the pumps, such that each of the pumps is detachably connected to any of the pumps.

Preferably, one of the first connecting member and the second connecting member is a male quick connector and the other one of the first connecting member and the second connecting member is a female quick connector.

According to another embodiment of the invention, a pump comprises a pump body, a first opening, a second opening, a first connecting member and a second connecting member. The first opening is located at a periphery of the pump body and the second opening is located at the periphery of the pump body. The first connecting member is disposed on the first opening and the second connecting member is disposed on the second opening.

Preferably, one of the first connecting member and the second connecting member is a male quick connector and the other one of the first connecting member and the second connecting member is a female quick connector.

According to another embodiment of the invention, a liquid cooling system comprises a pump and an external device. The pump comprises a pump body, a first opening, a second opening, a first connecting member and a second connecting member. The first opening and the second opening are located at a periphery of the pump body. The first connecting member is disposed on the first opening and the second connecting member is disposed on the second opening. The external device comprises a third opening and a third connecting member. The third connecting member is disposed on the third opening. The third connecting member is detachably connected to one of the first connecting member and the second connecting member, such that the external device is detachably connected to the pump.

Preferably, one of the first connecting member and the second connecting member is a male quick connector, the other one of the first connecting member and the second connecting member is a female quick connector, and the third connecting member is a male quick connector or a female quick connector.

As mentioned in the above, since the first opening and the second opening of each pump are equipped with the first connecting member and the second connecting member, respectively, for connecting other pumps, the invention allows a user to connect a plurality of pumps in series according to the needed flow rate. Specifically, the invention may design the first connecting member and the second connecting member to be a couple of male and female quick connectors, such that the user may attach/detach the pumps to/from each other more rapidly and conveniently. Furthermore, the invention may dispose the third connecting member on the external device such as liquid cooling head, radiator, and so on and design the third connecting member to be a male quick connector or a female quick connector, such that the pump of the invention may also be attached to the external device according to practical applications, so as to form the liquid cooling system.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
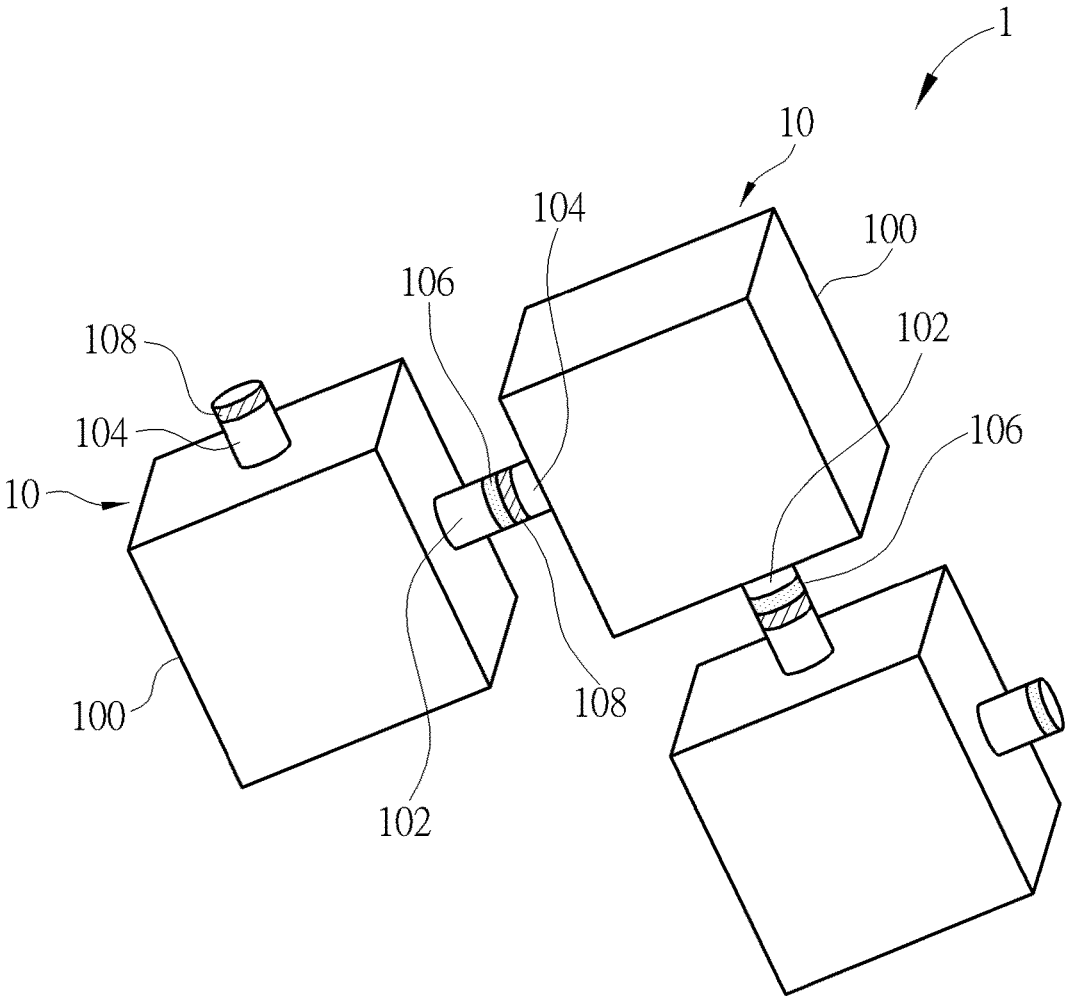
FIG. 1 is a schematic view illustrating a pump assembly according to an embodiment of the invention.
Figure 2:
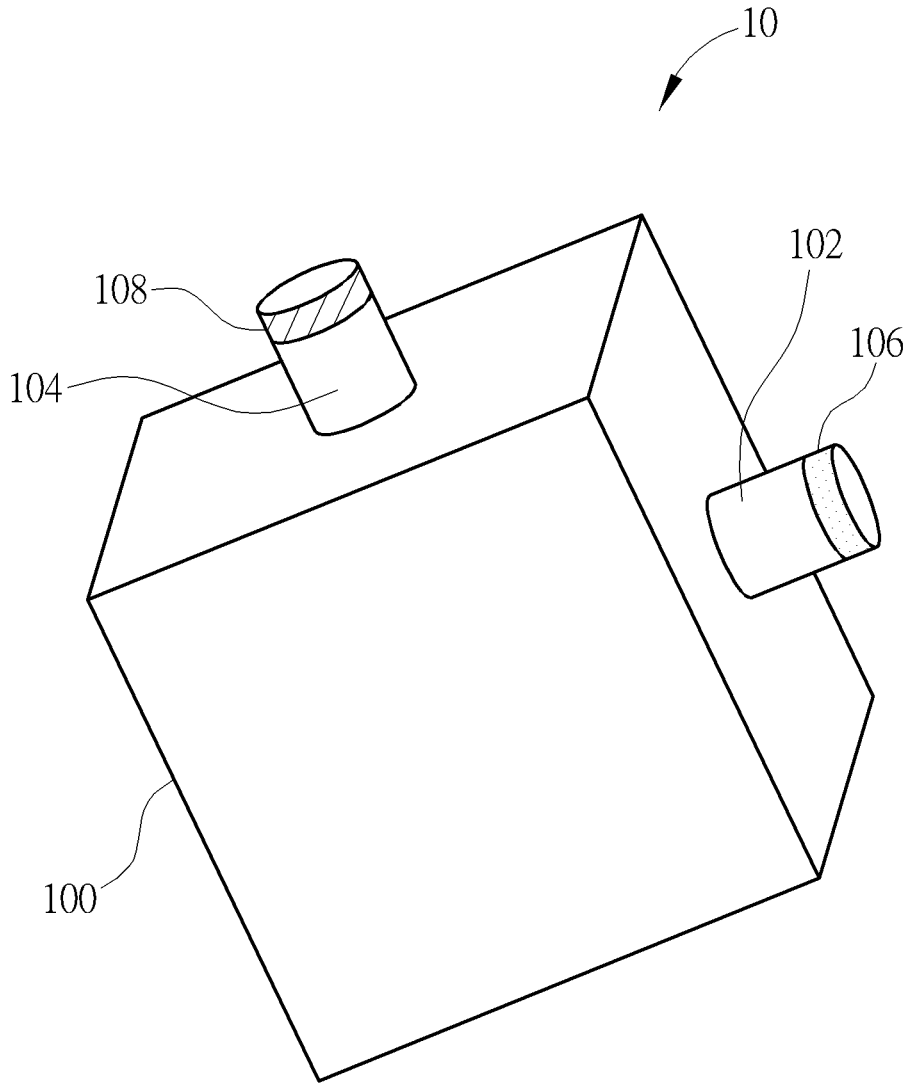
FIG. 2 is a schematic view illustrating one of the pumps shown in FIG. 1.

Referring to FIGS. 1 and 2, FIG. 1 is a schematic view illustrating a pump assembly 1 according to an embodiment of the invention and FIG. 2 is a schematic view illustrating one of the pumps 10 shown in FIG. 1.

As shown in FIGS. 1 and 2, the pump assembly 1 comprises a plurality of pumps 10. Each of the pumps 10 comprises a pump body 100, a first opening 102, a second opening 104, a first connecting member 106 and a second connecting member 108. The first opening 102 and the second opening 104 are located at a periphery of the pump body 100. In this embodiment, the first opening 102 may be an outlet and the second opening 104 may be an inlet, or alternatively, the first opening 102 may be an inlet and the second opening 104 may be an outlet. The first connecting member 106 is disposed on the first opening 102 and the second connecting member 108 is disposed on the second opening 104. Accordingly, the first connecting member 106 of one of the pumps 10 may be detachably connected to the second connecting member 108 of another of the pumps 10, such that each of the pumps 10 may be detachably connected to any of the pumps 10, as shown in FIG. 1.

In other words, since the first opening 102 and the second opening 104 of each pump 10 are equipped with the first connecting member 106 and the second connecting member 108, respectively, for connecting other pumps 10, the invention allows a user to connect a plurality of pumps 10 in series according to the needed flow rate. The pump assembly 1 shown in FIG. 1 consists of three pumps 10 connected to each other in series by the first connecting member 106 and the second connecting member 108 correspondingly. However, the user may connect two or more than three pumps 10 in series according to the needed flow rate.

The pump assembly 1 of the invention may be applied to, but not limited to, a liquid cooling system. It should be noted that the interior structure and the principle of the pump body 100 of the pump 10 is well known by one skilled in the art, so those will not be depicted herein again. Furthermore, the number and the position of the first opening 102 and the second opening 104 of each pump 10 may be determined according to practical applications, so those are not limited by the embodiment shown in the figure. For example, the pump 10 may also have two or more than two first openings 102 and/or second openings 104 according to practical applications. When the pump 10 has two or more than two first openings 102 and/or second openings 104, each first opening 102 may be equipped with a first connecting member 106 and each second opening 104 may be equipped with a second connecting member 108. In this embodiment, the first opening 102 and the second opening 104 are located at two adjacent surfaces of the pump body 100, respectively. However, in another embodiment, the first opening 102 and the second opening 104 may also be located at opposite surfaces of the pump body 100, respectively.

In this embodiment, one of the first connecting member 106 and the second connecting member 108 may be a male quick connector and the other one of the first connecting member 106 and the second connecting member 108 may be a female quick connector. In other words, the invention may design the first connecting member 106 and the second connecting member 108 to be a couple of male and female quick connectors, such that the user may attach/detach the pumps 10 to/from each other more rapidly and conveniently. In some embodiments, the quick connectors served as the first connecting member 106 and the second connecting member 108 may have quick attaching/detaching structure and have some structures for preventing a working fluid (e.g. cooling liquid) from leaking out of the pumps 10 while the pumps 10 are being attached to or detached from each other. In other embodiments, the first connecting member 106 and the second connecting member 108 may also be connected to each other in a screw manner.

In this embodiment, the pump body 100 of each of the pumps 10 is regular polygonal (e.g. square, regular pentagon, regular hexagon, etc.). Accordingly, the user may connect the pumps 10 in series by the first connecting member 106 and the second connecting member 108 correspondingly to form a regular or special shape, like building blocks or jigsaw puzzle. However, in another embodiment, the pump body 100 of each of the pumps 10 may also be arbitrary polygonal, circular or other shapes and it is not limited to regular polygonal. Moreover, the shape of the pump body 100 of each of the pumps 10 may be the same of different according to practical applications.

Figure 3:
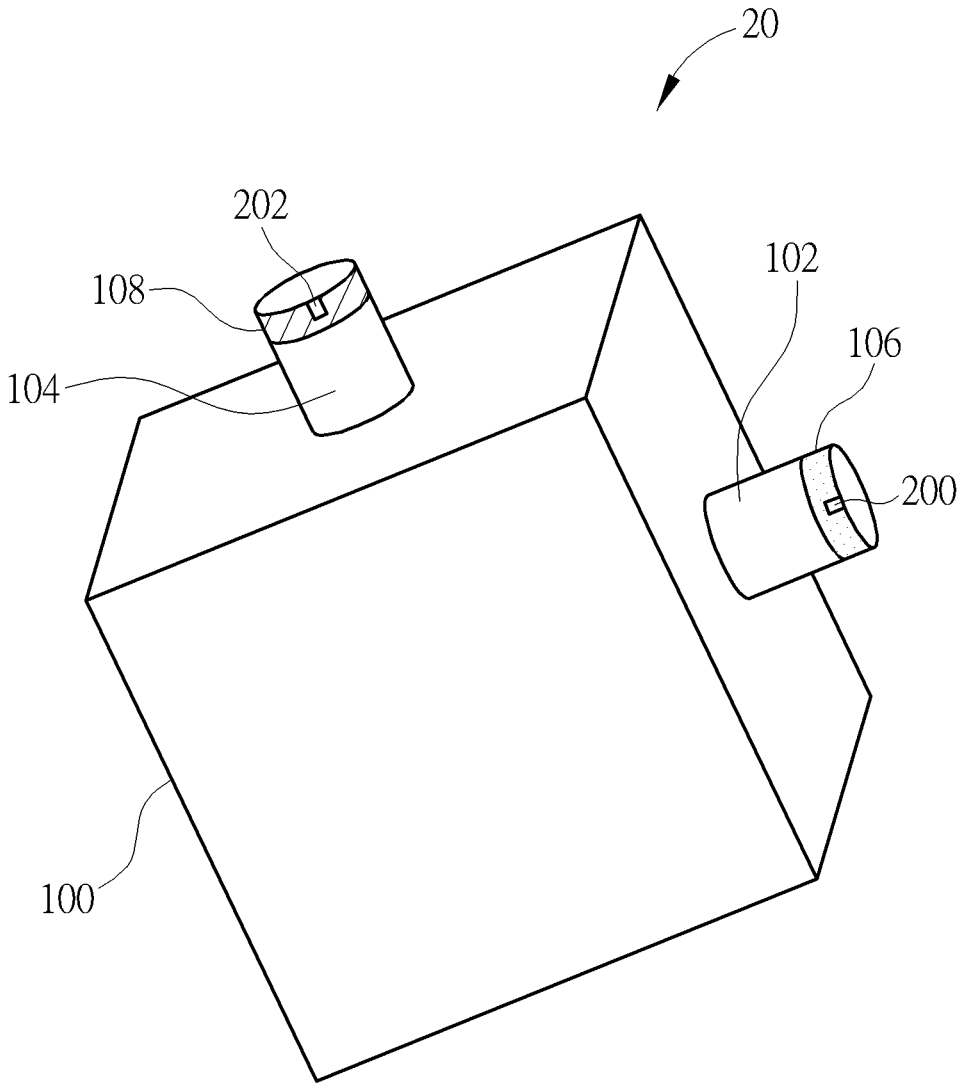
FIG. 3 is a schematic view illustrating a pump according to another embodiment of the invention.

Referring to FIG. 3, FIG. 3 is a schematic view illustrating a pump 20 according to another embodiment of the invention. The difference between the pump 20 and the aforesaid pump 10 is that the pump 20 further comprises a first electrical pad 200 and a second electrical pad 202, as shown in FIG. 3. In this embodiment, the first electrical pad 200 is disposed on the first connecting member 106 and the second electrical pad 202 is corresponding to the first electrical pad 200 and disposed on the second connecting member 108. However, in another embodiment, the first electrical pad 200 may also be disposed around the first opening 102 and the second electrical pad 202 corresponding to the first electrical pad 200 may also be disposed around the second opening 104. In other words, the first electrical pad 200 may be selectively disposed on the first connecting member 106 or around the first opening 102 and the second electrical pad 202 corresponding to the first electrical pad 200 may be selectively disposed on the second connecting member 108 or around the second opening 104. The invention is not limited to the embodiment shown in FIG. 3. When the first connecting member 106 of one of the pumps 20 is connected to the second connecting member 108 of another of the pumps 20, the first electrical pad 200 and the second electrical pad 202 of the two pumps 20 are electrically connected to each other. Therefore, as long as one of the pumps 20 connected in series is supplied with power, other pumps 20 may obtain power through the first electrical pad 200 and the second electrical pad 202. Accordingly, the invention may further save circuit layout space for the pump 20. It should be noted that the same elements in FIG. 3 and FIG. 2 are represented by the same numerals, so the repeated explanation will not be depicted herein again.

Figure 4:
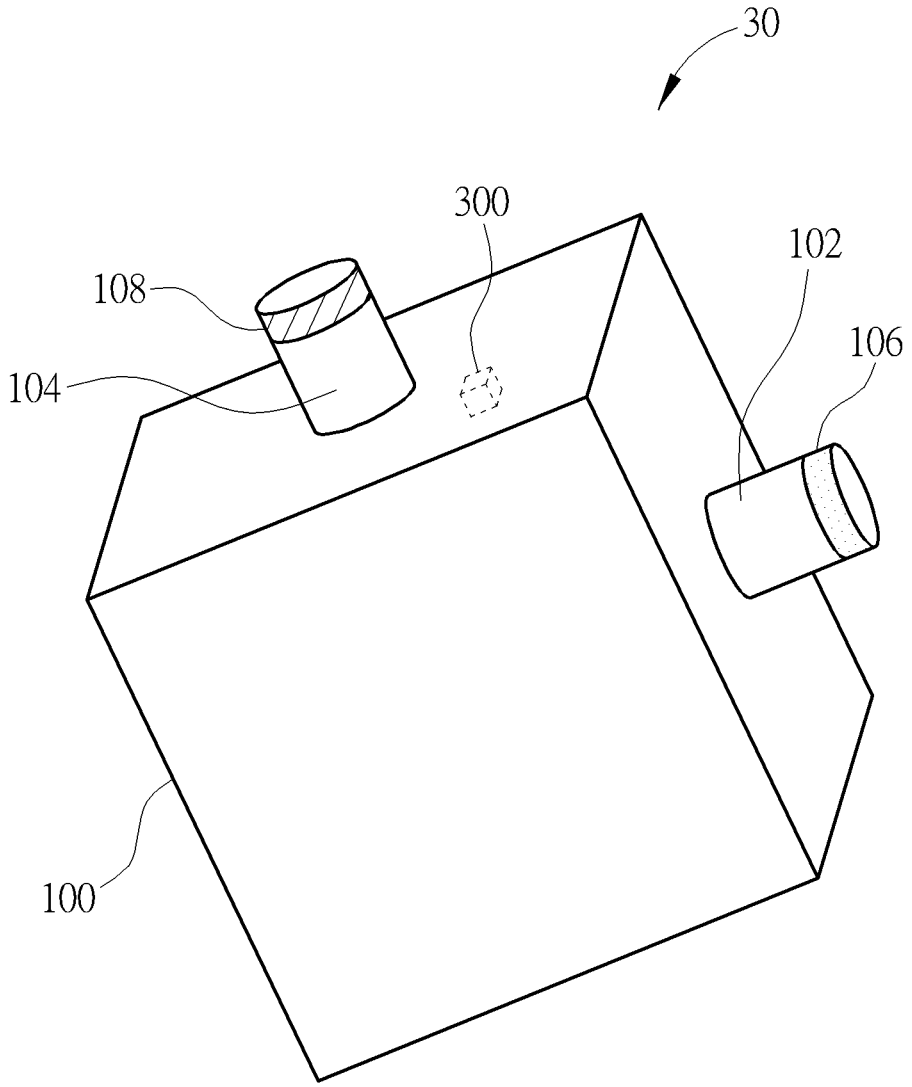
FIG. 4 is a schematic view illustrating a pump according to another embodiment of the invention.

Referring to FIG. 4, FIG. 4 is a schematic view illustrating a pump 30 according to another embodiment of the invention. The difference between the pump 30 and the aforesaid pump 10 is that the pump 30 further comprises a sensor 300, as shown in FIG. 4. The sensor 300 is used for sensing a flow rate, a pressure and/or a temperature of a working fluid (not shown) in the pump 30. In other words, the sensor 300 may be a flow rate sensor, a pressure sensor, a temperature sensor or a multi-function sensor capable of sensing at least two of flow rate, pressure and temperature simultaneously. Needless to say, the invention may also dispose the flow rate sensor, the pressure sensor and the temperature sensor in the pump 30 to sense the flow rate, the pressure and the temperature, respectively. In practical applications, the sensor 300 may be disposed around the first opening 102, around the second opening 104 or at other suitable positions in the pump body 100. It should be noted that the same elements in FIG. 4 and FIG. 2 are represented by the same numerals, so the repeated explanation will not be depicted herein again.

Figure 5:
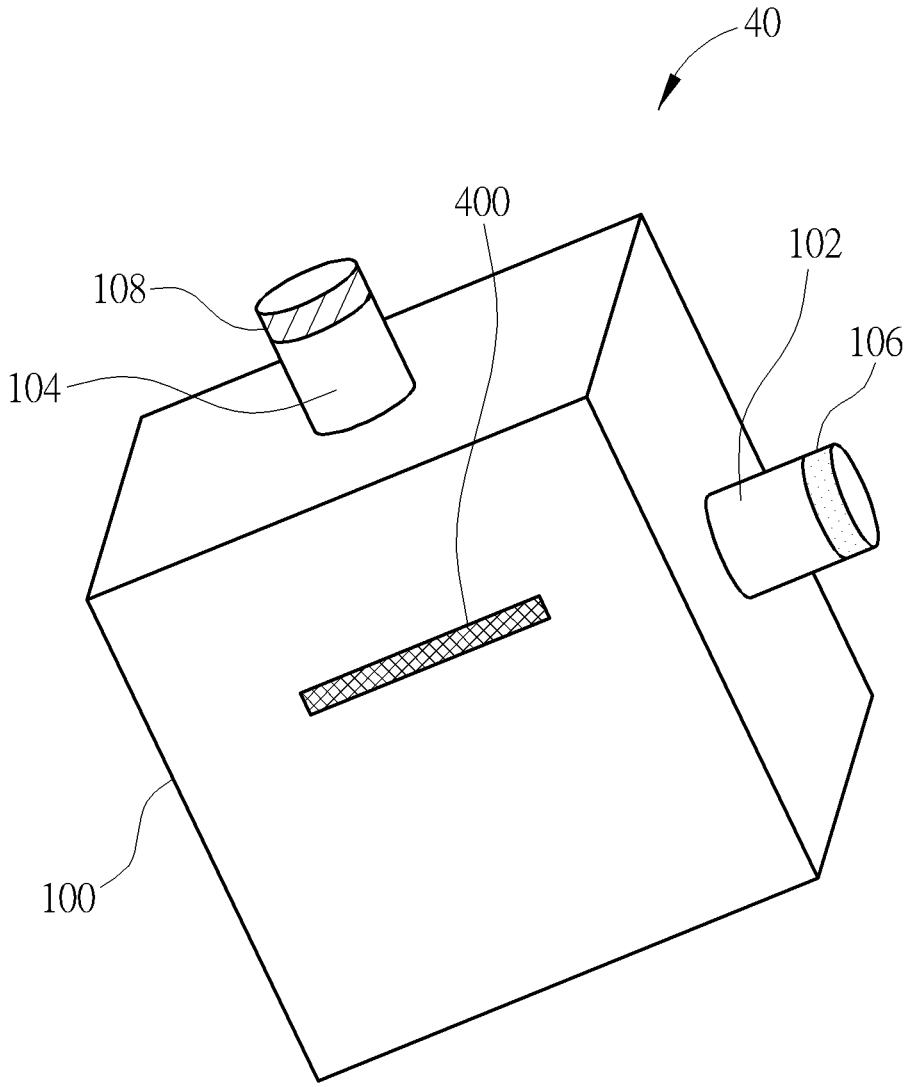
FIG. 5 is a schematic view illustrating a pump according to another embodiment of the invention.

Referring to FIG. 5, FIG. 5 is a schematic view illustrating a pump 40 according to another embodiment of the invention. The difference between the pump 40 and the aforesaid pump 10 is that the pump 40 further comprises a light emitting unit 400, as shown in FIG. 5. In this embodiment, the light emitting unit 400 may be disposed at a suitable position of the periphery of the pump body 100. The user may notice the position of the pump 40 rapidly according to the light emitted by the light emitting unit 400. Furthermore, the invention may also utilize the light emitting unit 400 to emit light with specific color(s), so as to enhance visual effect. In practical applications, the light emitting unit 400 may be a light emitting diode, a light bar or other light sources. It should be noted that the same elements in FIG. 5 and FIG. 2 are represented by the same numerals, so the repeated explanation will not be depicted herein again.

Figure 6:
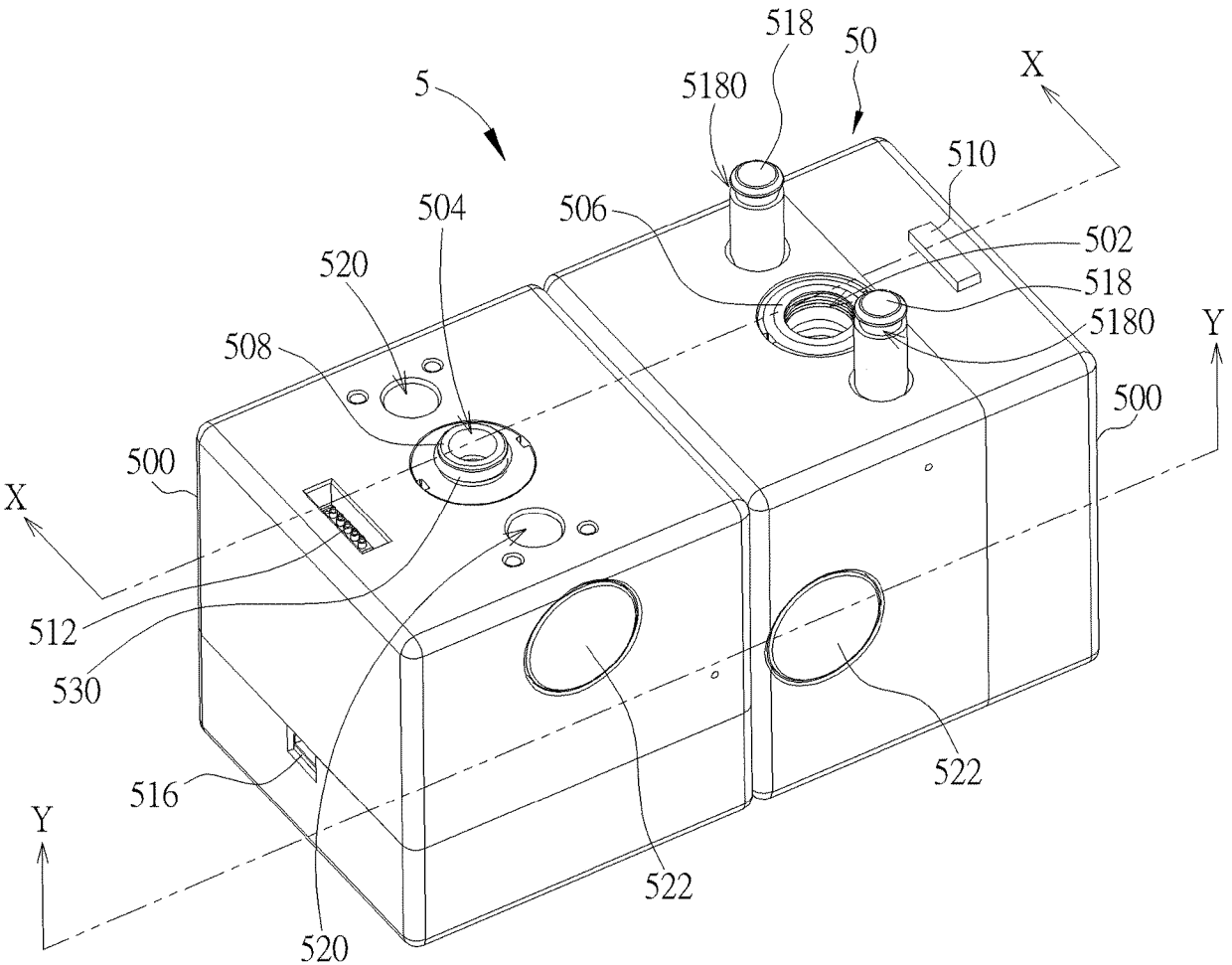
FIG. 6 is a schematic view illustrating a pump assembly according to another embodiment of the invention.
Figure 7:
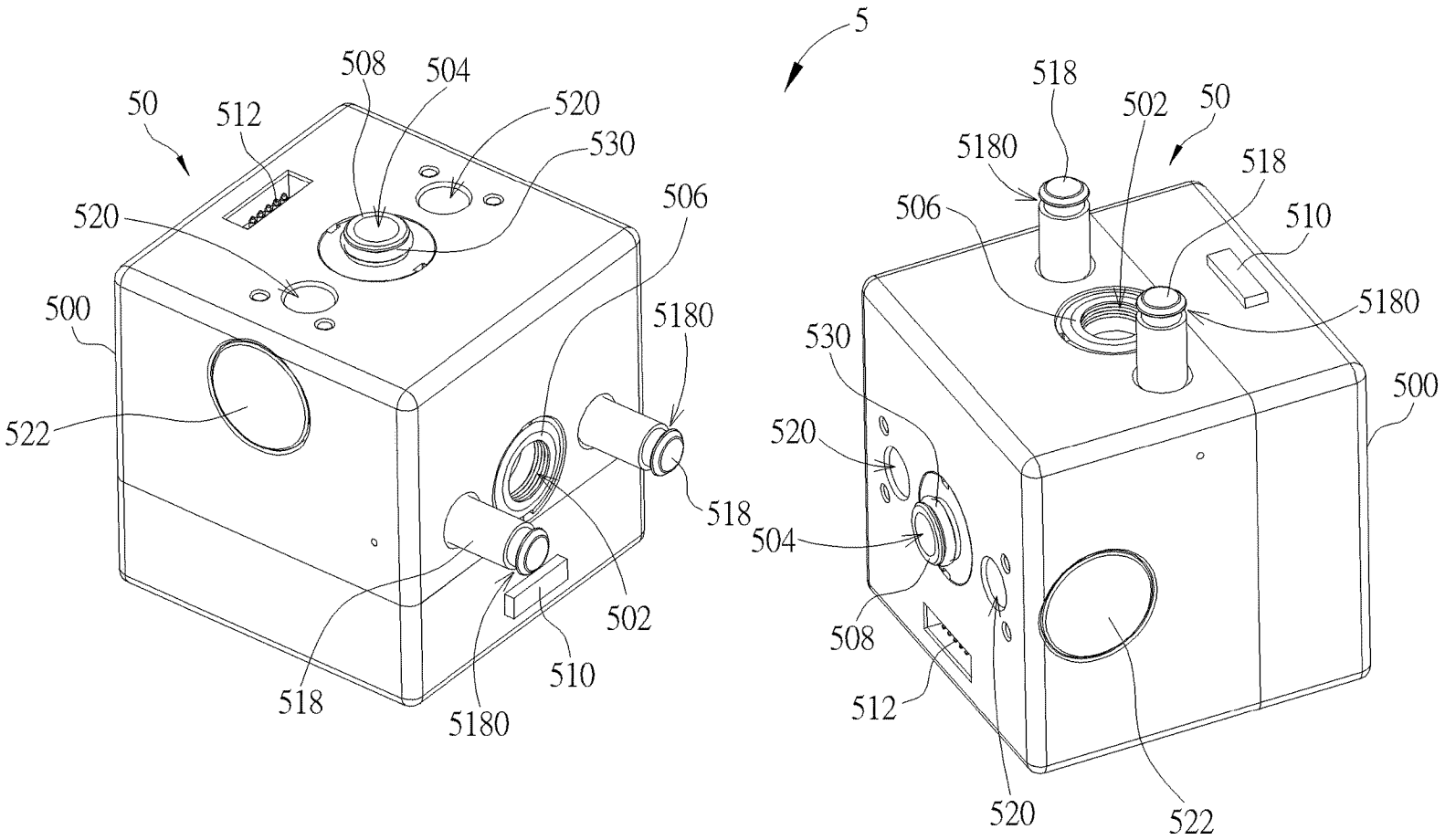
FIG. 7 is an exploded view illustrating the pump assembly shown in FIG. 6.
Figure 8:
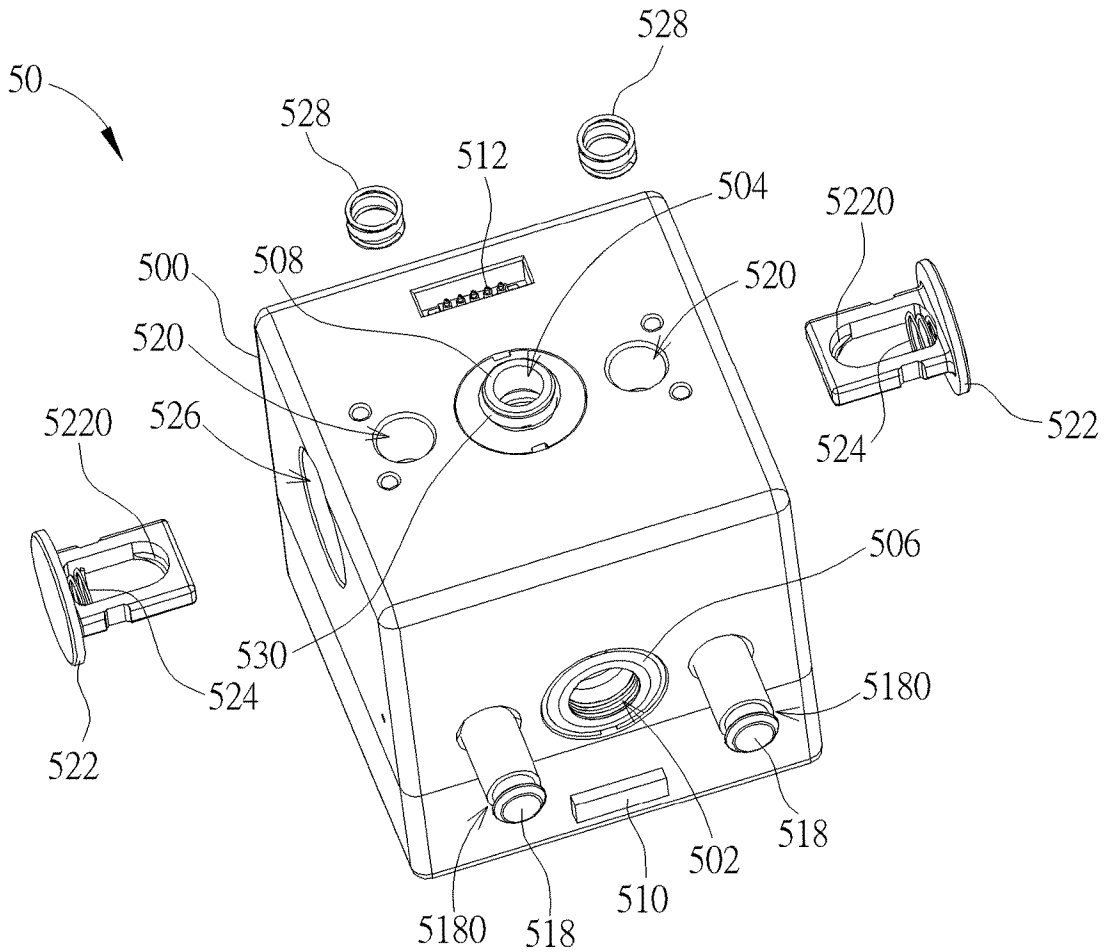
FIG. 8 is an exploded view illustrating one of the pumps shown in FIG. 7.
Figure 9:
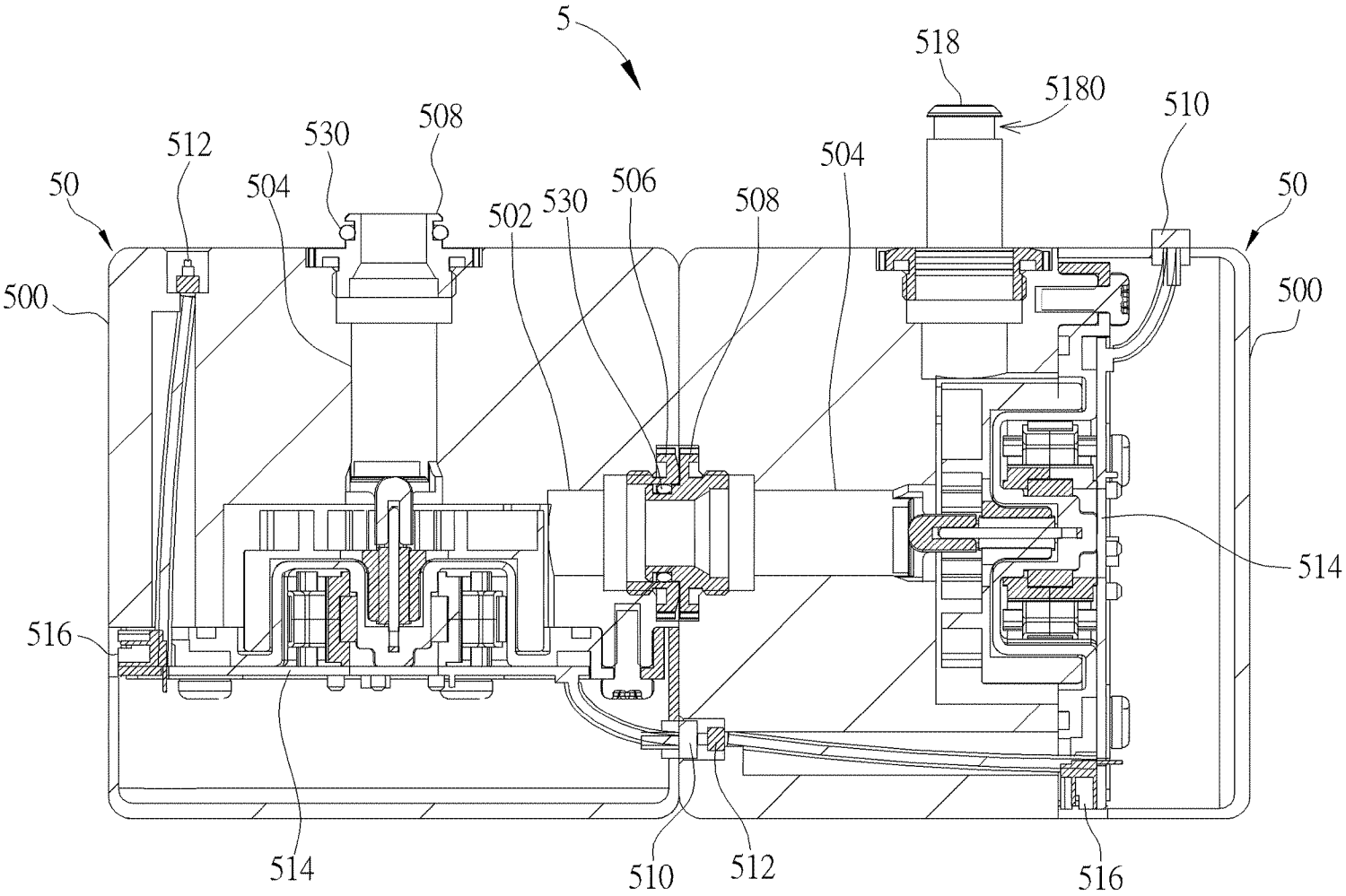
FIG. 9 is a sectional view illustrating the pump assembly along line X-X shown in FIG. 6.
Figure 10:
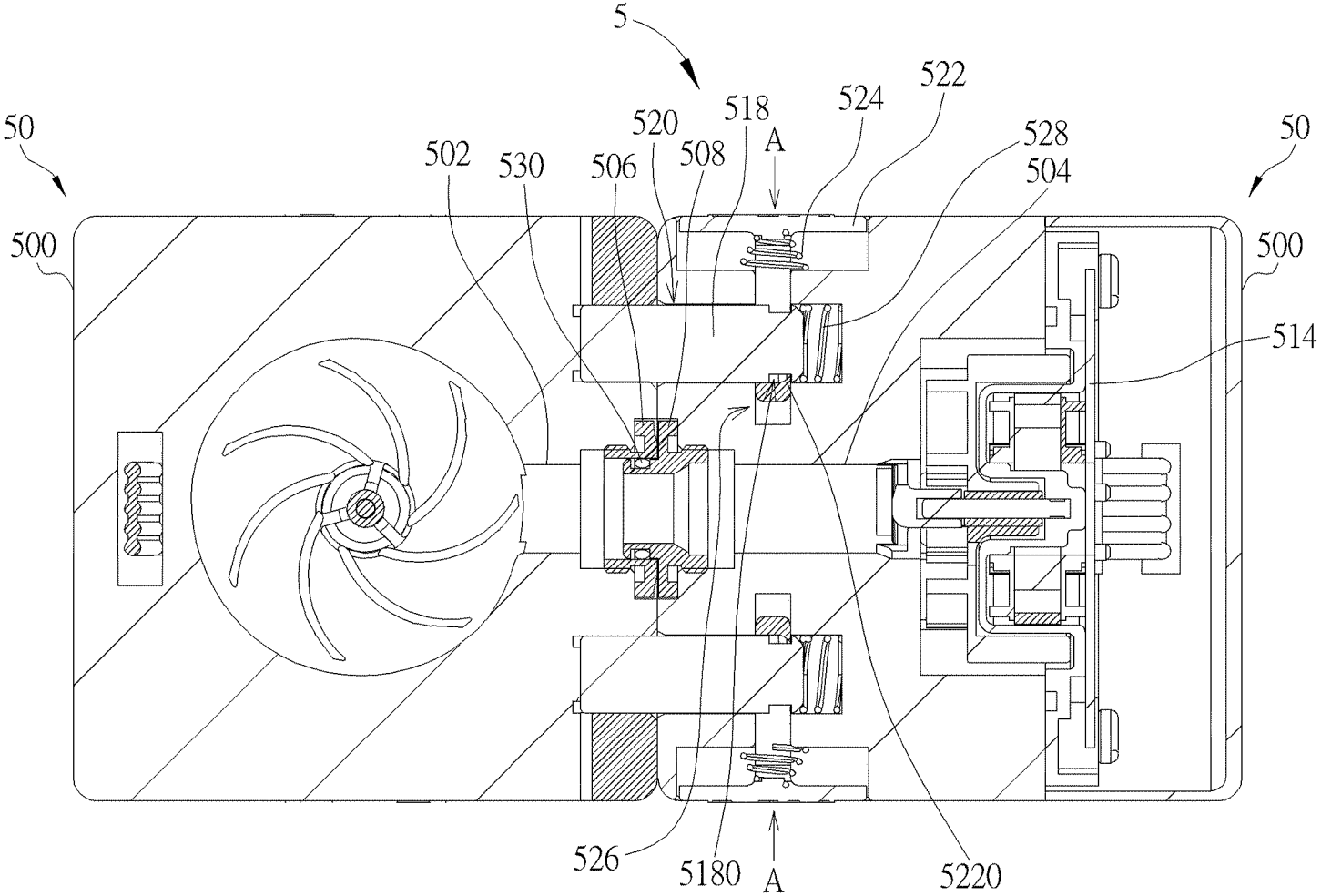
FIG. 10 is a sectional view illustrating the pump assembly along line Y-Y shown in FIG. 6.

Referring to FIGS. 6 and 10, FIG. 6 is a schematic view illustrating a pump assembly 5 according to another embodiment of the invention, FIG. 7 is an exploded view illustrating the pump assembly 5 shown in FIG. 6, FIG. 8 is an exploded view illustrating one of the pumps 50 shown in FIG. 7, FIG. 9 is a sectional view illustrating the pump assembly 5 along line X-X shown in FIG. 6, and FIG. 10 is a sectional view illustrating the pump assembly 5 along line Y-Y shown in FIG. 6.

As shown in FIGS. 6 to 10, the pump assembly 5 comprises a plurality of pumps 50. Each of the pumps 50 comprises a pump body 500, a first opening 502, a second opening 504, a first connecting member 506 and a second connecting member 508. The first opening 502 and the second opening 504 are located at a periphery of the pump body 500. In this embodiment, the first opening 502 may be an outlet and the second opening 504 may be an inlet, or alternatively, the first opening 502 may be an inlet and the second opening 504 may be an outlet. The first connecting member 506 is disposed on the first opening 502 and the second connecting member 508 is disposed on the second opening 504. Accordingly, the first connecting member 506 of one of the pumps 50 may be detachably connected to the second connecting member 508 of another of the pumps 50, such that each of the pumps 50 may be detachably connected to any of the pumps 50, as shown in FIGS. 6, 9 and 10.

In other words, since the first opening 502 and the second opening 504 of each pump 50 are equipped with the first connecting member 506 and the second connecting member 508, respectively, for connecting other pumps 50, the invention allows a user to connect a plurality of pumps 50 in series according to the needed flow rate. The pump assembly 5 shown in FIG. 6 consists of two pumps 50 connected to each other in series by the first connecting member 506 and the second connecting member 508 correspondingly. However, the user may connect more than two pumps 50 in series according to the needed flow rate.

The pump assembly 5 of the invention may be applied to, but not limited to, a liquid cooling system. It should be noted that the interior structure and the principle of the pump body 500 of the pump 50 is well known by one skilled in the art, so those will not be depicted herein again. Furthermore, the number and the position of the first opening 502 and the second opening 504 of each pump 50 may be determined according to practical applications, so those are not limited by the embodiment shown in the figure. For example, the pump 50 may also have two or more than two first openings 502 and/or second openings 504 according to practical applications. When the pump 50 has two or more than two first openings 502 and/or second openings 504, each first opening 502 may be equipped with a first connecting member 506 and each second opening 504 may be equipped with a second connecting member 508. In this embodiment, the first opening 502 and the second opening 504 are located at two adjacent surfaces of the pump body 500, respectively. However, in another embodiment, the first opening 502 and the second opening 504 may also be located at opposite surfaces of the pump body 500, respectively.

In this embodiment, one of the first connecting member 506 and the second connecting member 508 may be a male quick connector and the other one of the first connecting member 506 and the second connecting member 508 may be a female quick connector. In other words, the invention may design the first connecting member 506 and the second connecting member 508 to be a couple of male and female quick connectors, such that the user may attach/detach the pumps 50 to/from each other more rapidly and conveniently. As shown in FIGS. 6 to 10, the first connecting member 506 is a female quick connector and the second connecting member 508 is a male quick connector. In some embodiments, the quick connectors served as the first connecting member 506 and the second connecting member 508 may have quick attaching/detaching structure and have some structures for preventing a working fluid (e.g. cooling liquid) from leaking out of the pumps 50 while the pumps 50 are being attached to or detached from each other. In other embodiments, the first connecting member 506 and the second connecting member 508 may also be connected to each other in a screw manner.

In this embodiment, the pump body 500 of each of the pumps 50 is regular polygonal (e.g. square, regular pentagon, regular hexagon, etc.). Accordingly, the user may connect the pumps 50 in series by the first connecting member 506 and the second connecting member 508 correspondingly to form a regular or special shape, like building blocks or jigsaw puzzle. However, in another embodiment, the pump body 500 of each of the pumps 50 may also be arbitrary polygonal, circular or other shapes and it is not limited to regular polygonal. Moreover, the shape of the pump body 500 of each of the pumps 50 may be the same of different according to practical applications.

In this embodiment, each of the pumps 50 may further comprise a first electrical pad 510 and a second electrical pad 512. As shown in FIG. 7, the first electrical pad 510 may be disposed around the first opening 502 and the second electrical pad 512 corresponding to the first electrical pad 510 may be disposed around the second opening 504. Furthermore, each of the pumps 50 may further comprise a circuit board 514 and a power connector 516. As shown in FIG. 9, the circuit board 514 and the power connector 516 are disposed in the pump body 500, wherein the power connector 516, the first electrical pad 510 and the second electrical pad 512 are electrically connected to the circuit board 514.

When the first connecting member 506 of one of the pumps 50 is connected to the second connecting member 508 of another of the pumps 50, the first electrical pad 510 is electrically connected to the second electrical pad 512 correspondingly. The user may connect a power cable with a power source (not shown) to the power connector 516, such that power can be supplied to the first electrical pad 510 and the second electrical pad 512 through the power connector 516. Therefore, as long as one of the pumps 50 connected in series is supplied with power, other pumps 50 may obtain power through the first electrical pad 510 and the second electrical pad 512. Accordingly, the invention may further save circuit layout space for the pump 50.

In this embodiment, each of the pumps 50 may further comprise a guiding pin 518 and a guiding hole 520. As shown in FIG. 7, each of the pumps 50 comprises two guiding pins 518 and two guiding holes 520. The guiding pins 518 are disposed on the pump body 500 and around the first connecting member 506. The guiding holes 520 are formed on the pump body 500 and around the second connecting member 508. When a user wants to connect two pumps 50 in series, the user may insert the guiding pins 518 into the guiding holes 520, so as to connect the first connecting member 506 of one pump 50 and the second connecting member 508 of another pump 50. As shown in FIG. 10, when the first connecting member 506 of one pump 50 is connected to the second connecting member 508 of another pump 50, the guiding pins 518 are inserted into the guiding holes 520 correspondingly. In other words, the guiding pins 518 and the guiding holes 520 can assist the user in connecting two pumps 50 in series rapidly and conveniently.

In this embodiment, each of the pumps 50 may further comprise a release button 522 and a first resilient member 524. As shown in FIG. 8, each of the pumps 50 comprises two release buttons 522 and two first resilient members 524. The first resilient members 524 may be, but not limited to, springs. As shown in FIG. 10, the release button 522 is movably disposed on the pump body 500 and the first resilient member 524 is located between and abuts against the release button 522 and the pump body 500. The release button 522 has an engaging portion 5220. A through hole 526 is formed on the pump body 500 and communicates with the guiding hole 520. The engaging portion 5220 of the release button 522 is inserted into the through hole 526 and passes through the guiding hole 520. The guiding pin 518 has an engaging groove 5180.

As shown in FIG. 10, when the guiding pin 518 is inserted into the guiding hole 520, the engaging portion 5220 of the release button 522 is engaged with the engaging groove 5180 of the guiding pin 518. Accordingly, when two pumps 50 are connected to each other through the first connecting member 506 and the second connecting member 508, the two pumps 50 will not come off each other due to the engagement formed by the engaging portion 5220 of the release button 522 and the engaging groove 5180 of the guiding pin 518. If the user wants to detach the two pumps 50 from each other, the user may press the release button 522 in the direction indicated by an arrow A, so as to disengage the engaging portion 5220 from the engaging groove 5180 of the guiding pin 518. Once the engaging portion 5220 of the release button 522 is disengaged from the engaging groove 5180 of the guiding pin 518, the user can detach the two pumps 50 from each other by separating the first connecting member 506 and the second connecting member 508 from each other. It should be noted that when the user presses the release button 522, the first resilient member 524 is compressed by the release button 522. When the user looses the release button 522, the first resilient member 524 generates an elastic force to push the release button 522 back.

In this embodiment, each of the pumps 50 may further comprise a second resilient member 528 disposed in the guiding hole 520. As shown in FIG. 8, each of the pumps 50 comprises two second resilient members 528. The second resilient members 528 may be, but not limited to, springs. As shown in FIG. 10, when the guiding pin 518 is inserted into the guiding hole 520, the second resilient member 528 is compressed by the guiding pin 518. When the release button 522 is pressed to disengage the engaging portion 5220 from the engaging groove 5180 of the guiding pin 518, the second resilient member 528 generates an elastic force to push the guiding pin 518 out of the guiding hole 520. Accordingly, the user can detach the pumps 50 from each other much more easily.

In this embodiment, each of the pumps 50 may further comprise a washer 530 selectively disposed on one of the first connecting member 506 and the second connecting member 508. As shown in FIG. 7, the washer 530 is disposed on the second connecting member 508. However, in another embodiment, the washer 530 may be disposed on the first connecting member 506. As shown in FIGS. 9 and 10, when the first connecting member 506 is connected to the second connecting member 508, the washer 530 is located between and abuts against the first connecting member 506 and the second connecting member 508, so as to prevent a working fluid (e.g. cooling liquid) from leaking out of the pumps 50.

Figure 11:
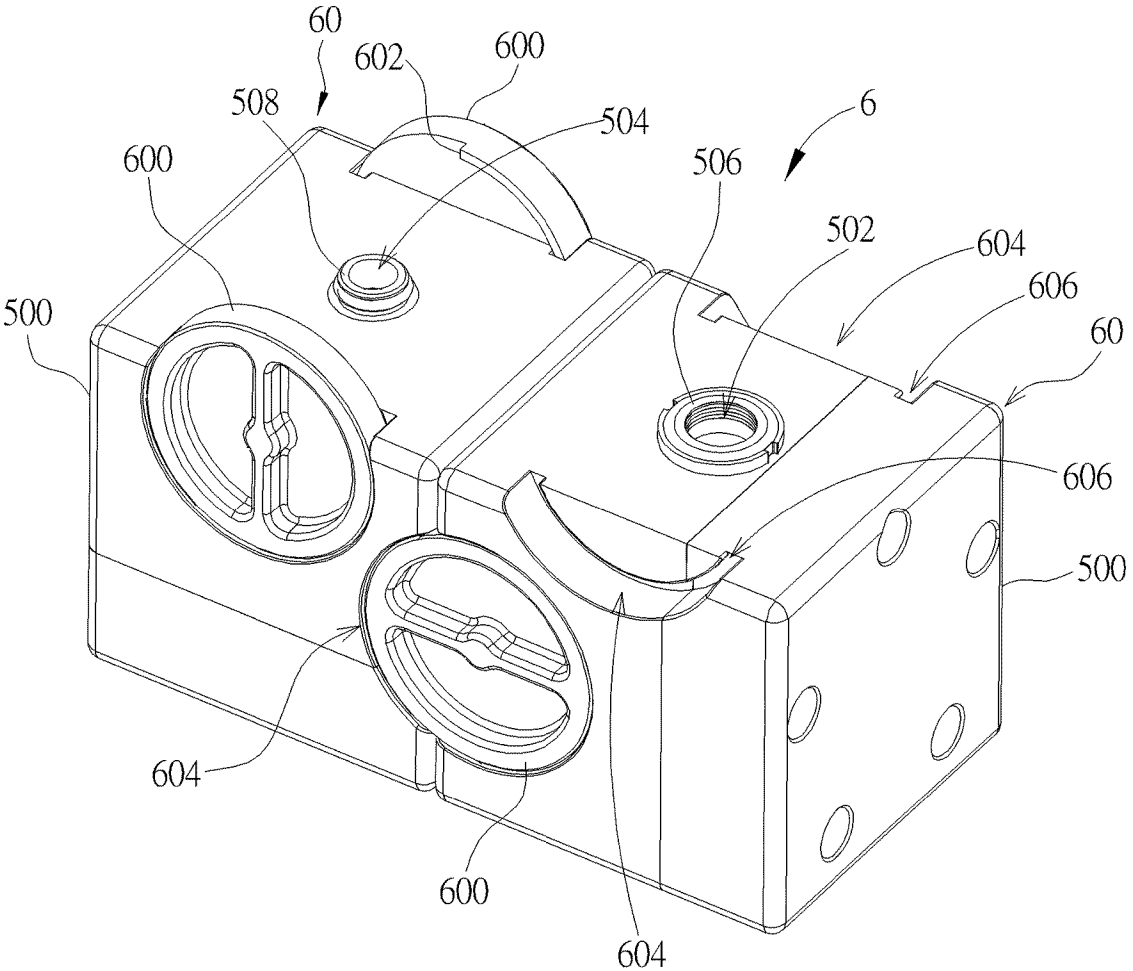
FIG. 11 is a schematic view illustrating a pump assembly according to another embodiment of the invention.
Figure 12:
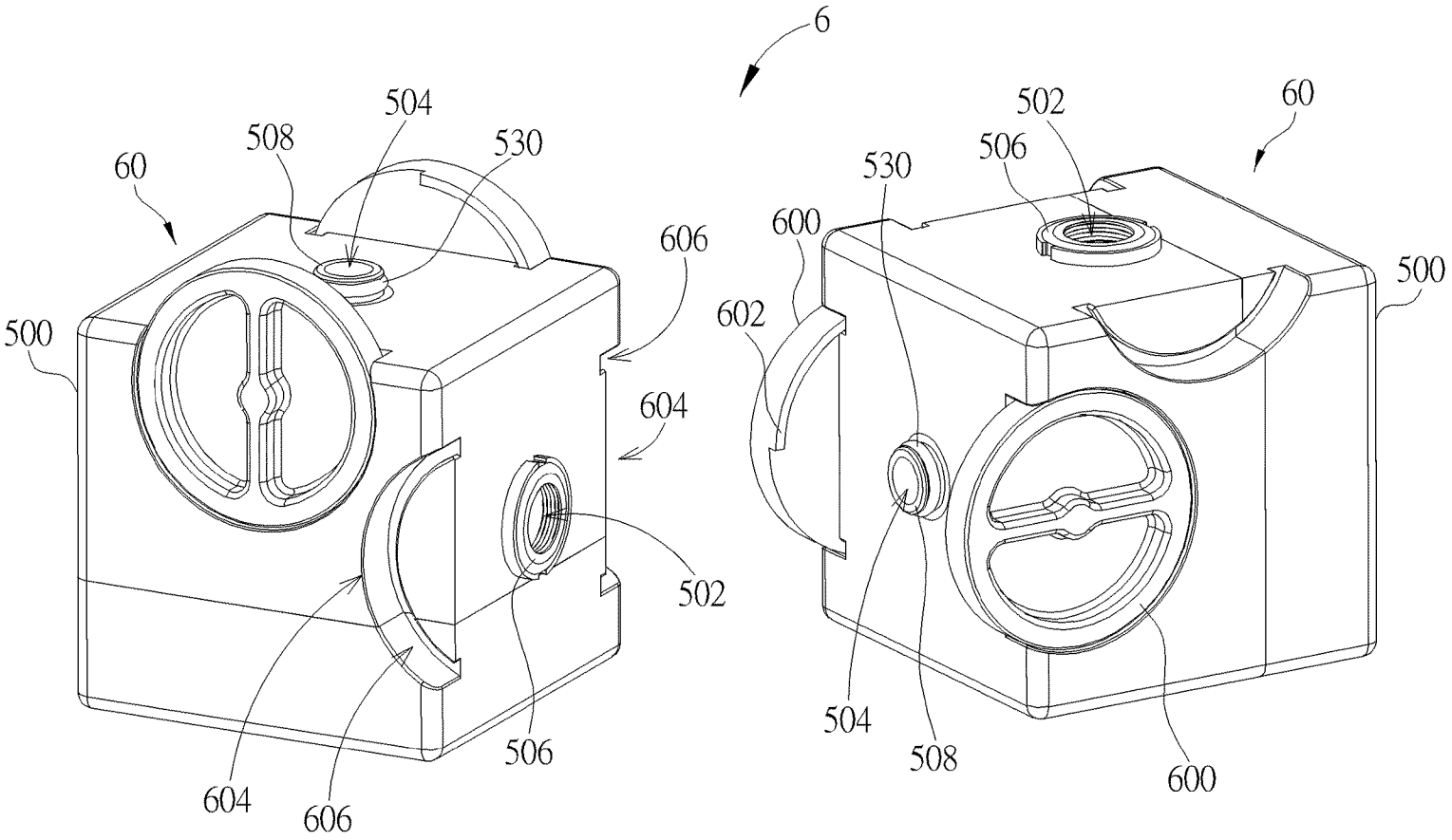
FIG. 12 is an exploded view illustrating the pump assembly shown in FIG. 11.

Referring to FIGS. 11 and 12, FIG. 11 is a schematic view illustrating a pump assembly 6 according to another embodiment of the invention and FIG. 12 is an exploded view illustrating the pump assembly 6 shown in FIG. 11. The difference between the pump assembly 6 and the aforesaid pump assembly 5 is that each of the pumps 60 of the pump assembly 6 comprises a rotating member 600. As shown in FIGS. 11 and 12, each of the pumps 60 comprises two rotating members 600. The rotating member 600 is rotatably disposed on the pump body 500 and the rotating member 600 has an engaging portion 602. Furthermore, a recess 604 is formed on the pump body 500 and the recess 604 has an engaging groove 606. In this embodiment, when the first connecting member 506 is connected to the second connecting member 508, a part of the rotating member 600 is accommodated in the recess 604 correspondingly. When the part of the rotating member 600 is accommodated in the recess 604, the rotating member 600 is capable of being rotated to enable the engaging portion 602 to be engaged with or disengaged from the engaging groove 606.

For example, when the first connecting member 506 is connected to the second connecting member 508 and the part of the rotating member 600 is accommodated in the recess 604, the user may rotate the rotating member 600 to enable the engaging portion 602 to be engaged with the engaging groove 606. Accordingly, two pumps 60 are connected to each other through the first connecting member 506 and the second connecting member 508 and will not come off each other due to the engagement formed by the engaging portion 602 of the rotating member 600 and the engaging groove 606 of the recess 604. If the user wants to detach the two pumps 60 from each other, the user may rotate the rotating member 600 to enable the engaging portion 602 to be disengaged from the engaging groove 606. Once the engaging portion 602 of the rotating member 600 is disengaged from the engaging groove 606 of the recess 604, the user can detach the two pumps 60 from each other by separating the first connecting member 506 and the second connecting member 508 from each other. In other words, the invention may replace the aforesaid guiding pin 518 and guiding hole 520 by the rotating member 600 and the recess 604, so as to achieve the same function. It should be noted that the same elements in FIGS. 11-12 and FIGS. 6-10 are represented by the same numerals, so the repeated explanation will not be depicted herein again.

Figure 13:
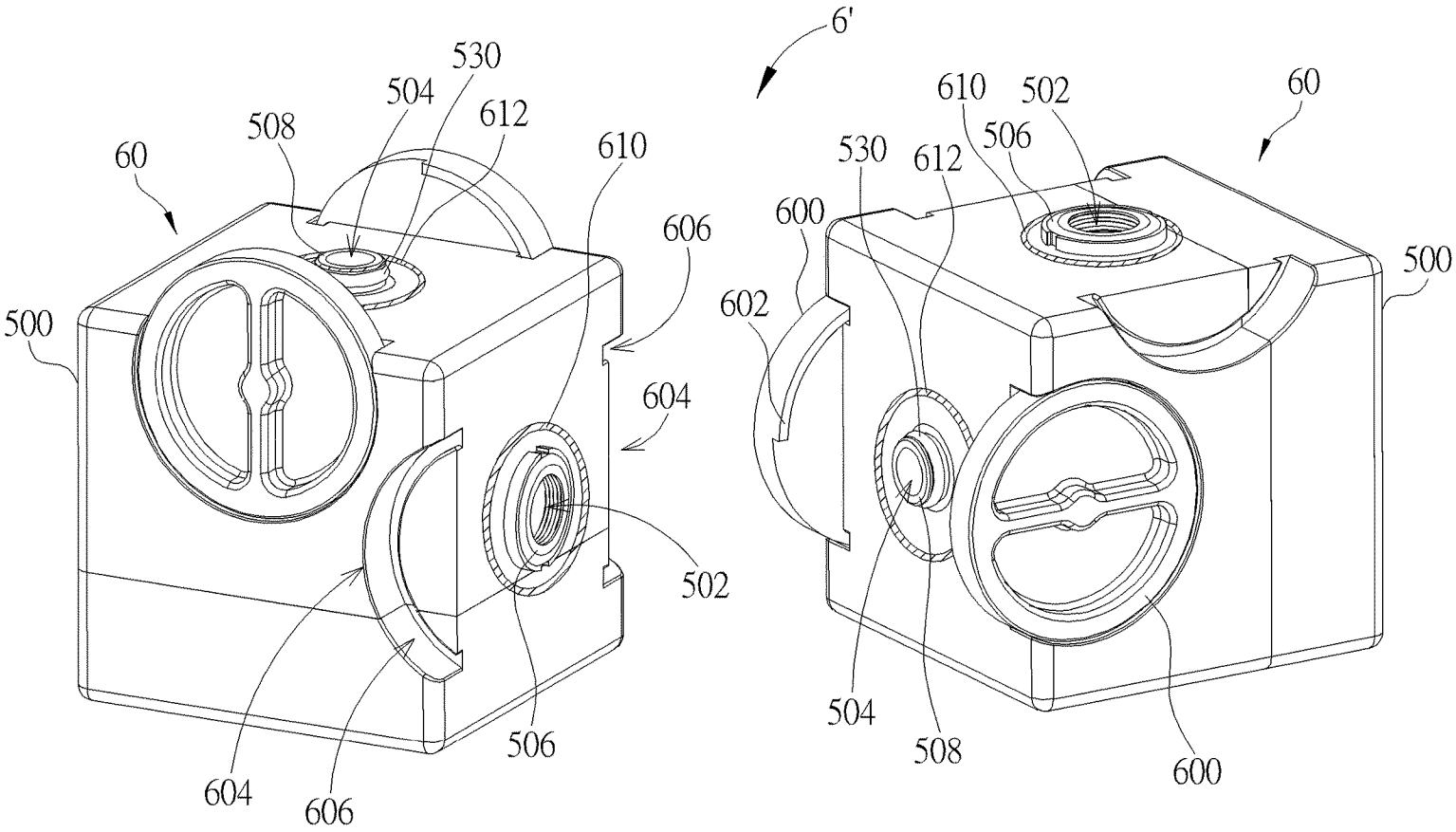
FIG. 13 is an exploded view illustrating a pump assembly according to another embodiment of the invention.

Referring to FIG. 13, FIG. 13 is an exploded view illustrating a pump assembly 6' according to another embodiment of the invention. The difference between the pump assembly 6' and the aforesaid pump assembly 6 is that each of the pumps 60 of the pump assembly 6' further comprises a first electrical pad 610 and a second electrical pad 612. In this embodiment, the first electrical pad 610 and the second electrical pad 612 are circular. As shown in FIG. 13, the first electrical pad 610 is disposed around the first opening 502 and the second electrical pad 612 is corresponding to the first electrical pad 610 and disposed around the second opening 504. When the first connecting member 506 of one of the pumps 60 is connected to the second connecting member 508 of another of the pumps 60, the first electrical pad 610 and the second electrical pad 612 of the two pumps 60 are electrically connected to each other. Therefore, as long as one of the pumps 60 connected in series is supplied with power, other pumps 60 may obtain power through the first electrical pad 610 and the second electrical pad 612. Accordingly, the invention may further save circuit layout space for the pump 60. It should be noted that the same elements in FIG. 13 and FIGS. 11-12 are represented by the same numerals, so the repeated explanation will not be depicted herein again.

It should be noted that the first electrical pad 610 and the second electrical pad 612 may consist of at least one signal line and at least one power line, wherein the signal line is used for detecting whether the first electrical pad 610 and the second electrical pad 612 are electrically connected to each other well and the power line is used for supplying power between the first electrical pad 610 and the second electrical pad 612. Since the first electrical pad 610 and the second electrical pad 612 are circular, the two pumps 60 connected to each other can rotate with respect to each other and the first electrical pad 610 and the second electrical pad 612 can still keep good electrical connection.

Figure 14:
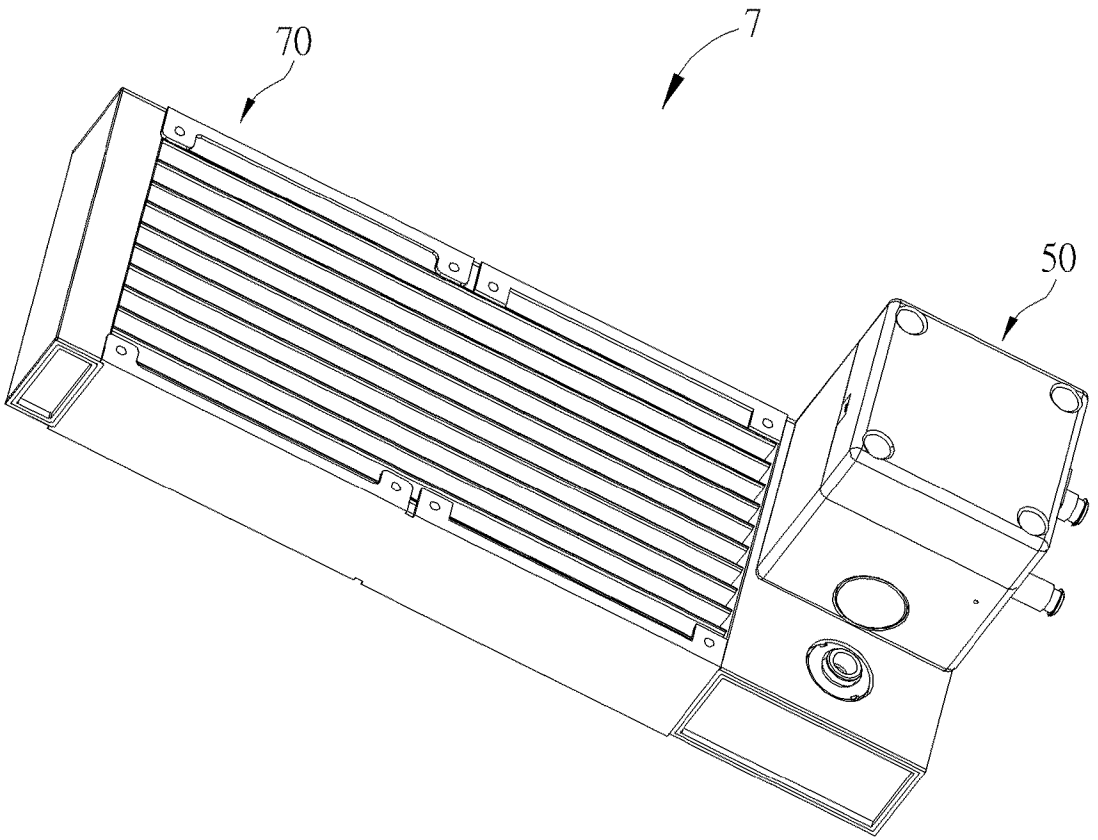
FIG. 14 is a schematic view illustrating a liquid cooling system according to another embodiment of the invention.
Figure 15:
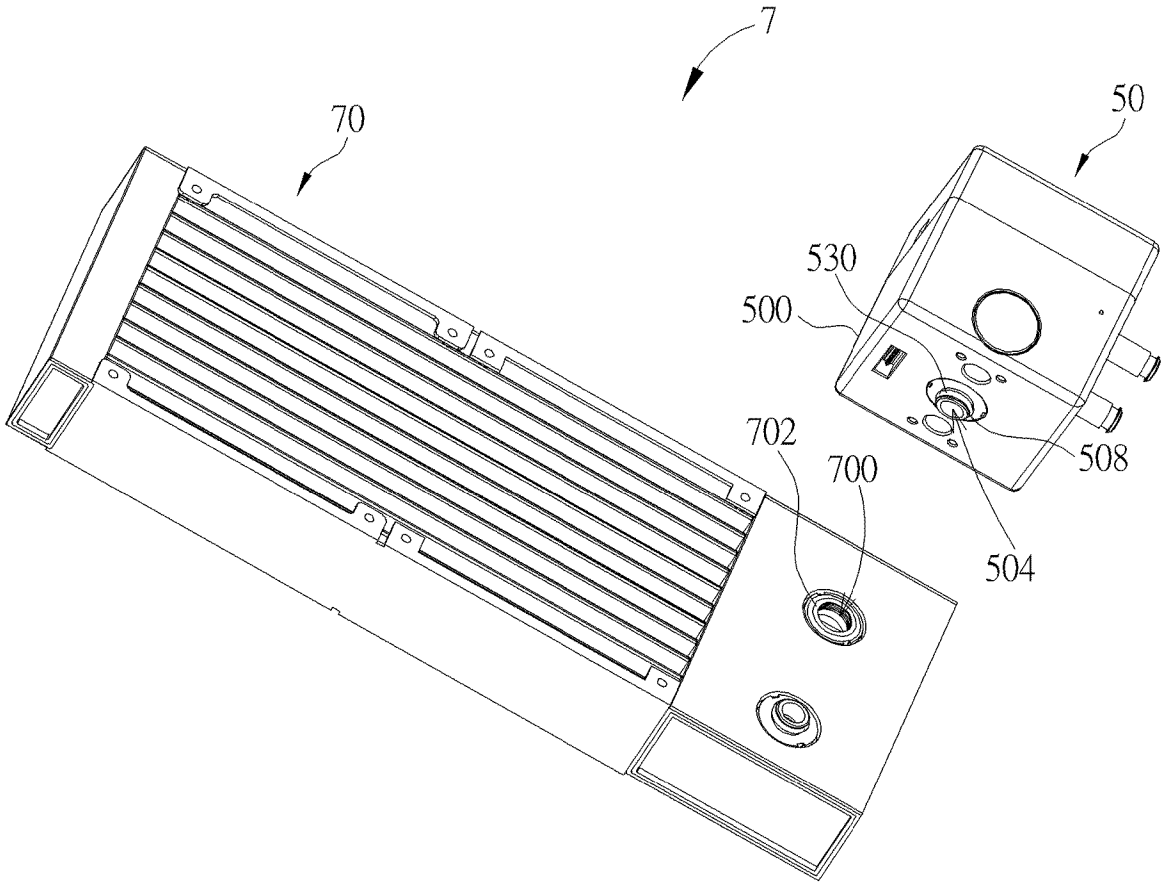
FIG. 15 is an exploded view illustrating the liquid cooling system shown in FIG. 14.

Referring to FIGS. 14 and 15, FIG. 14 is a schematic view illustrating a liquid cooling system 7 according to another embodiment of the invention and FIG. 15 is an exploded view illustrating the liquid cooling system 7 shown in FIG. 14. As shown in FIGS. 14 and 15, the liquid cooling system 7 comprises a pump 50 and an external device 70. It should be noted that the structure of the pump 50 has been mentioned in the above, so it will not be depicted herein again. The external device 70 comprises a third opening 700 and a third connecting member 702. As shown in FIG. 15, the third connecting member 702 is disposed on the third opening 700. Accordingly, the third connecting member 702 of the external device may be detachably connected to the second connecting member 508 of the pump 50, such that the external device 70 may be detachably connected to the pump 50, as shown in FIG. 14.

In this embodiment, the second opening 504 may be an outlet and the third opening 700 may be an inlet, or alternatively, the second opening 504 may be an inlet and the third opening 700 may be an outlet. Furthermore, the external device 70 may be, but not limited to, a radiator. Moreover, the third connecting member 702 may be a male quick connector or a female quick connector according to the type of the second connecting member 508. For example, as shown in FIG. 15, since the second connecting member 508 of the pump 50 is a male quick connector, the third connecting member 702 should be a female quick connector correspondingly.

Figure 16:
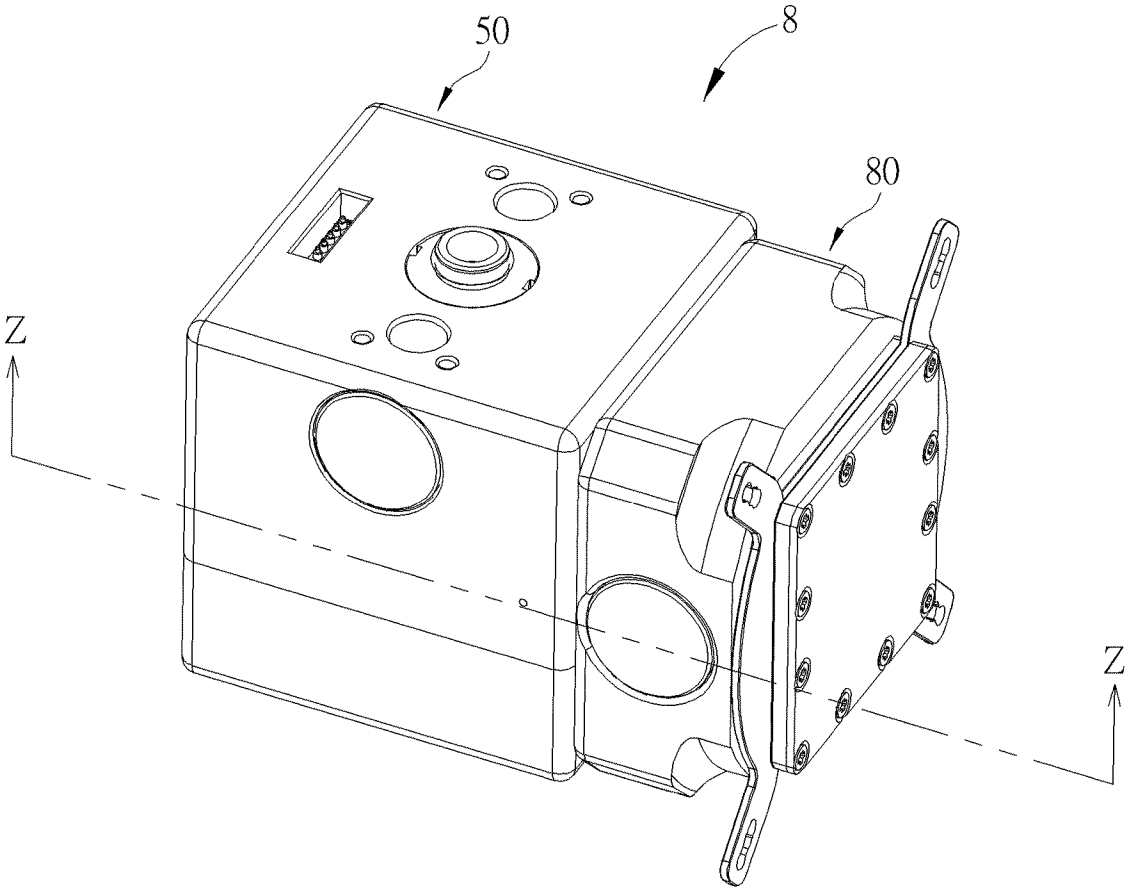
FIG. 16 is a schematic view illustrating a liquid cooling system according to another embodiment of the invention.
Figure 17:
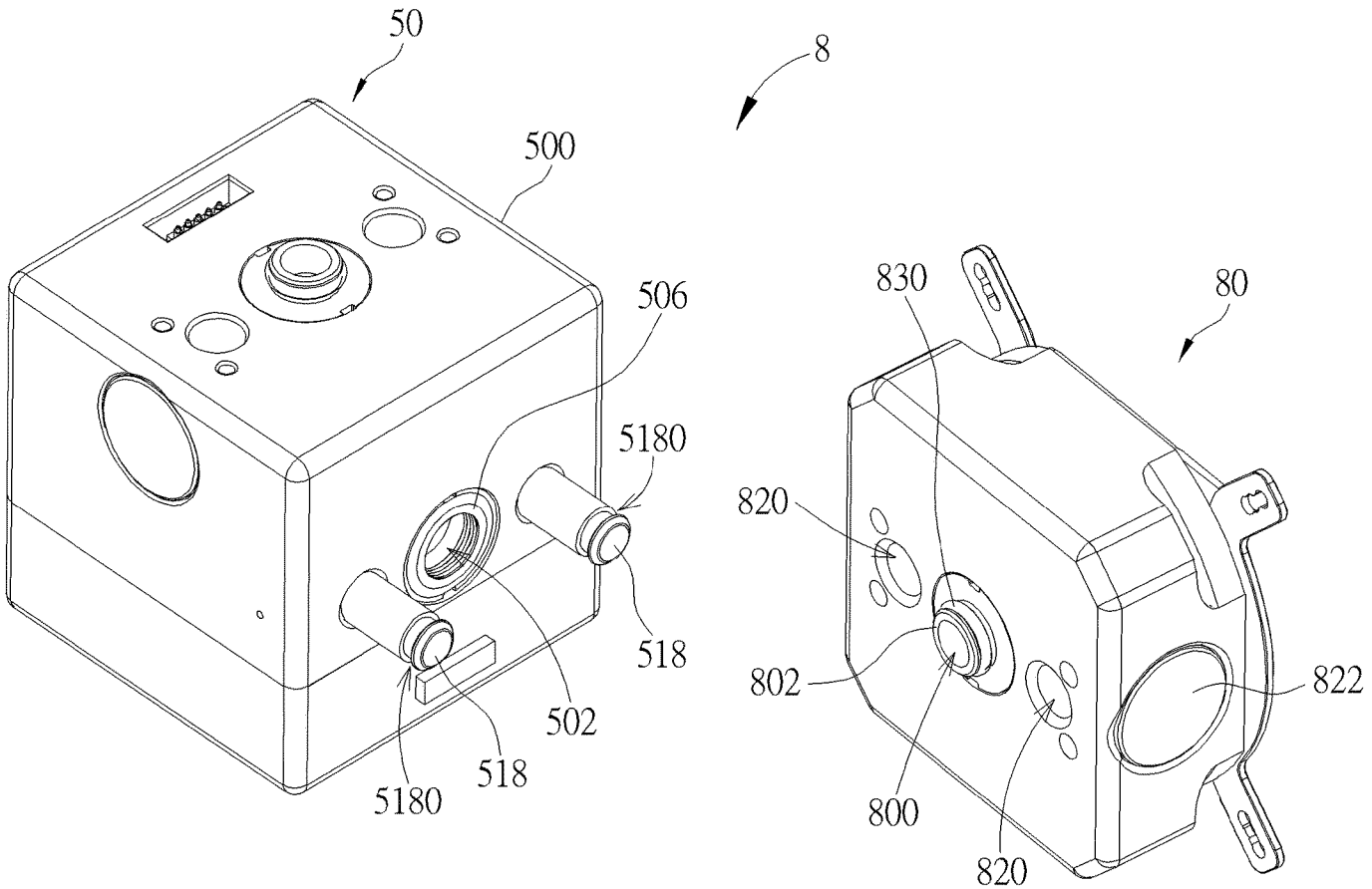
FIG. 17 is an exploded view illustrating the liquid cooling system shown in FIG. 16.
Figure 18:
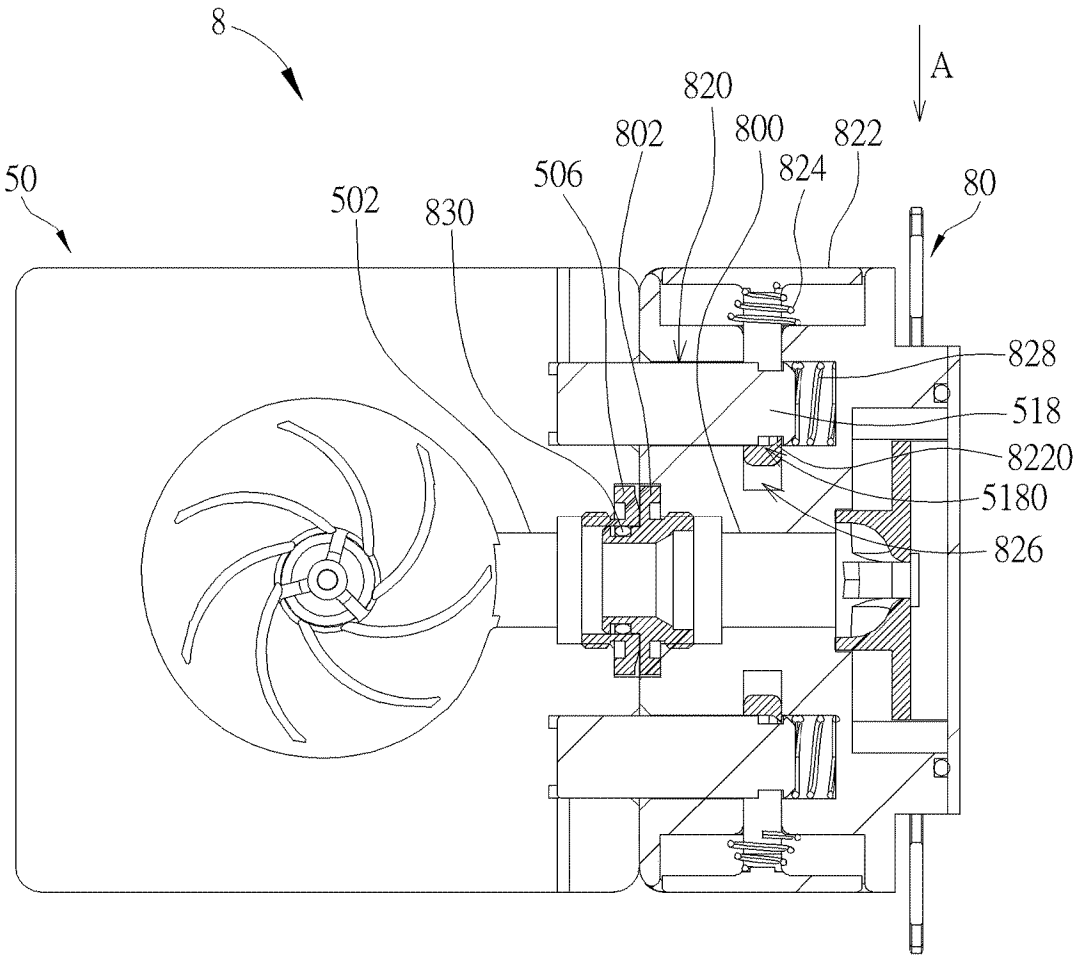
FIG. 18 is a sectional view illustrating the liquid cooling system along line Z-Z shown in FIG. 16.

Referring to FIGS. 16 to 18, FIG. 16 is a schematic view illustrating a liquid cooling system 8 according to another embodiment of the invention, FIG. 17 is an exploded view illustrating the liquid cooling system 8 shown in FIG. 16, and FIG. 18 is a sectional view illustrating the liquid cooling system 8 along line Z-Z shown in FIG. 16. As shown in FIGS. 16 to 18, the liquid cooling system 8 comprises a pump 50 and an external device 80. It should be noted that the structure of the pump 50 has been mentioned in the above, so it will not be depicted herein again. The external device 80 comprises a third opening 800 and a third connecting member 802. As shown in FIG. 17, the third connecting member 802 is disposed on the third opening 800. Accordingly, the third connecting member 802 of the external device 80 may be detachably connected to the first connecting member 506 of the pump 50, such that the external device 80 may be detachably connected to the pump 50, as shown in FIG. 16.

In this embodiment, the first opening 502 may be an outlet and the third opening 800 may be an inlet, or alternatively, the first opening 502 may be an inlet and the third opening 800 may be an outlet. Furthermore, the external device 80 may be, but not limited to, a liquid cooling head. Moreover, the third connecting member 802 may be a male quick connector or a female quick connector according to the type of the first connecting member 506. For example, as shown in FIG. 17, since the first connecting member 506 of the pump 50 is a female quick connector, the third connecting member 802 should be a male quick connector correspondingly.

In this embodiment, the external device 80 may further comprise a guiding hole 820. As shown in FIG. 17, the external device 80 comprises two guiding holes 820. The guiding holes 820 are formed around the third connecting member 802. When a user wants to connect the pump 50 and the external device 80, the user may insert the guiding pins 518 of the pump 50 into the guiding holes 820 of the external device 80, so as to connect the first connecting member 506 of the pump 50 and the third connecting member 802 of the external device 80. As shown in FIG. 18, when the first connecting member 506 of the pump 50 is connected to the third connecting member 802 of the external device 80, the guiding pins 518 are inserted into the guiding holes 820 correspondingly. In other words, the guiding pins 518 and the guiding holes 820 can assist the user in connecting the pump 50 and the external device 80 rapidly and conveniently.

In this embodiment, the external device 80 may further comprise a release button 822 and a first resilient member 824. As shown in FIG. 18, the external device 80 comprises two release buttons 822 and two first resilient members 824.

The first resilient members 824 may be, but not limited to, springs. The release button 822 is movably disposed on the external device 80 and the first resilient member 824 is located between and abuts against the release button 822 and the external device 80. The release button 822 has an engaging portion 8220. A through hole 826 is formed on the external device 80 and communicates with the guiding hole 820. The engaging portion 8220 of the release button 822 is inserted into the through hole 826 and passes through the guiding hole 820.

As shown in FIG. 18, when the guiding pin 518 of the pump 50 is inserted into the guiding hole 820 of the external device 80, the engaging portion 8220 of the release button 822 is engaged with the engaging groove 5180 of the guiding pin 518. Accordingly, when the pump 50 and the external device 80 are connected to each other through the first connecting member 506 and the third connecting member 802, the pump 50 and the external device 80 will not come off each other due to the engagement formed by the engaging portion 8220 of the release button 822 and the engaging groove 5180 of the guiding pin 518. If the user wants to detach the pump 50 and the external device 80 from each other, the user may press the release button 822 in the direction indicated by an arrow A, so as to disengage the engaging portion 8220 from the engaging groove 5180 of the guiding pin 518. Once the engaging portion 8220 of the release button 822 is disengaged from the engaging groove 5180 of the guiding pin 518, the user can detach the pump 50 and the external device 80 from each other by separating the first connecting member 506 and the third connecting member 802 from each other. It should be noted that when the user presses the release button 822, the first resilient member 824 is compressed by the release button 822. When the user looses the release button 822, the first resilient member 824 generates an elastic force to push the release button 822 back.

In this embodiment, the external device 80 may further comprise a second resilient member 828 disposed in the guiding hole 820. As shown in FIG. 18, the external device 80 comprises two second resilient members 828. The second resilient members 828 may be, but not limited to, springs. When the guiding pin 518 of the pump 50 is inserted into the guiding hole 820 of the external device 80, the second resilient member 828 is compressed by the guiding pin 518. When the release button 822 is pressed to disengage the engaging portion 8220 from the engaging groove 5180 of the guiding pin 518, the second resilient member 828 generates an elastic force to push the guiding pin 518 out of the guiding hole 820. Accordingly, the user can detach the pump 50 and the external device 80 from each other much more easily.

In this embodiment, the external device 80 may further comprise a washer 830 disposed on the third connecting member 802. As shown in FIG. 18, when the first connecting member 506 is connected to the third connecting member 802, the washer 830 abuts against between the first connecting member 506 and the third connecting member 802, so as to prevent a working fluid (e.g. cooling liquid) from leaking out of the pump 50 and the external device 80.

Figure 19:
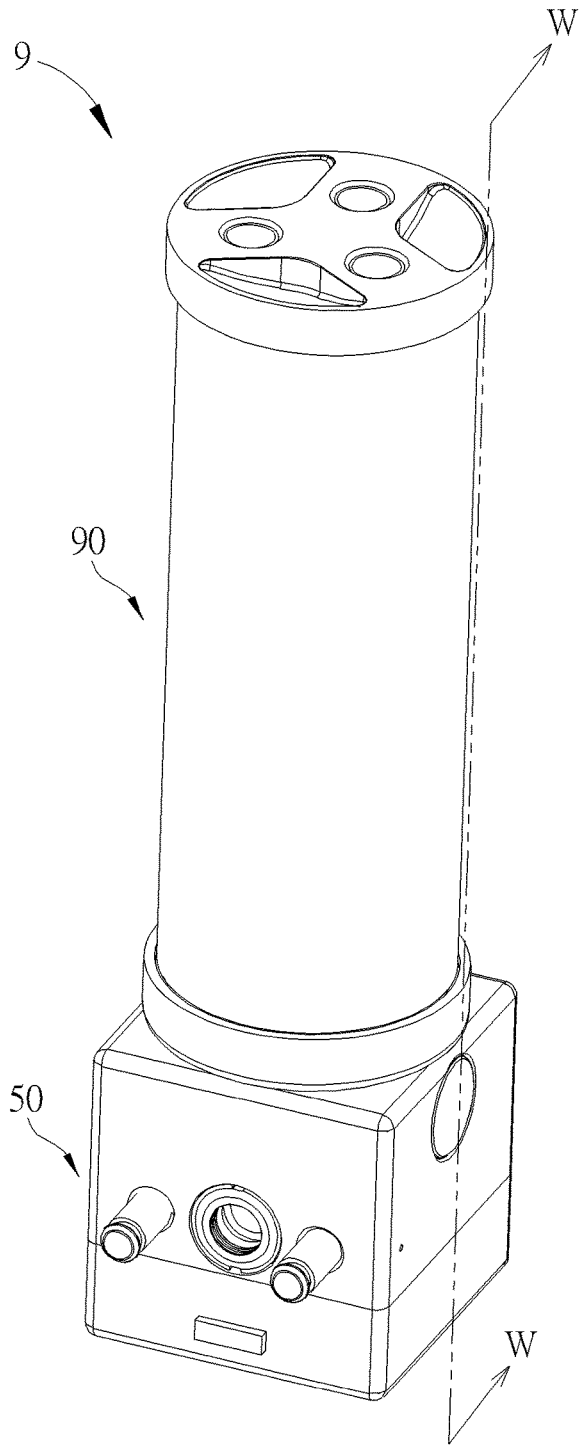
FIG. 19 is a schematic view illustrating a liquid cooling system according to another embodiment of the invention.
Figure 20:
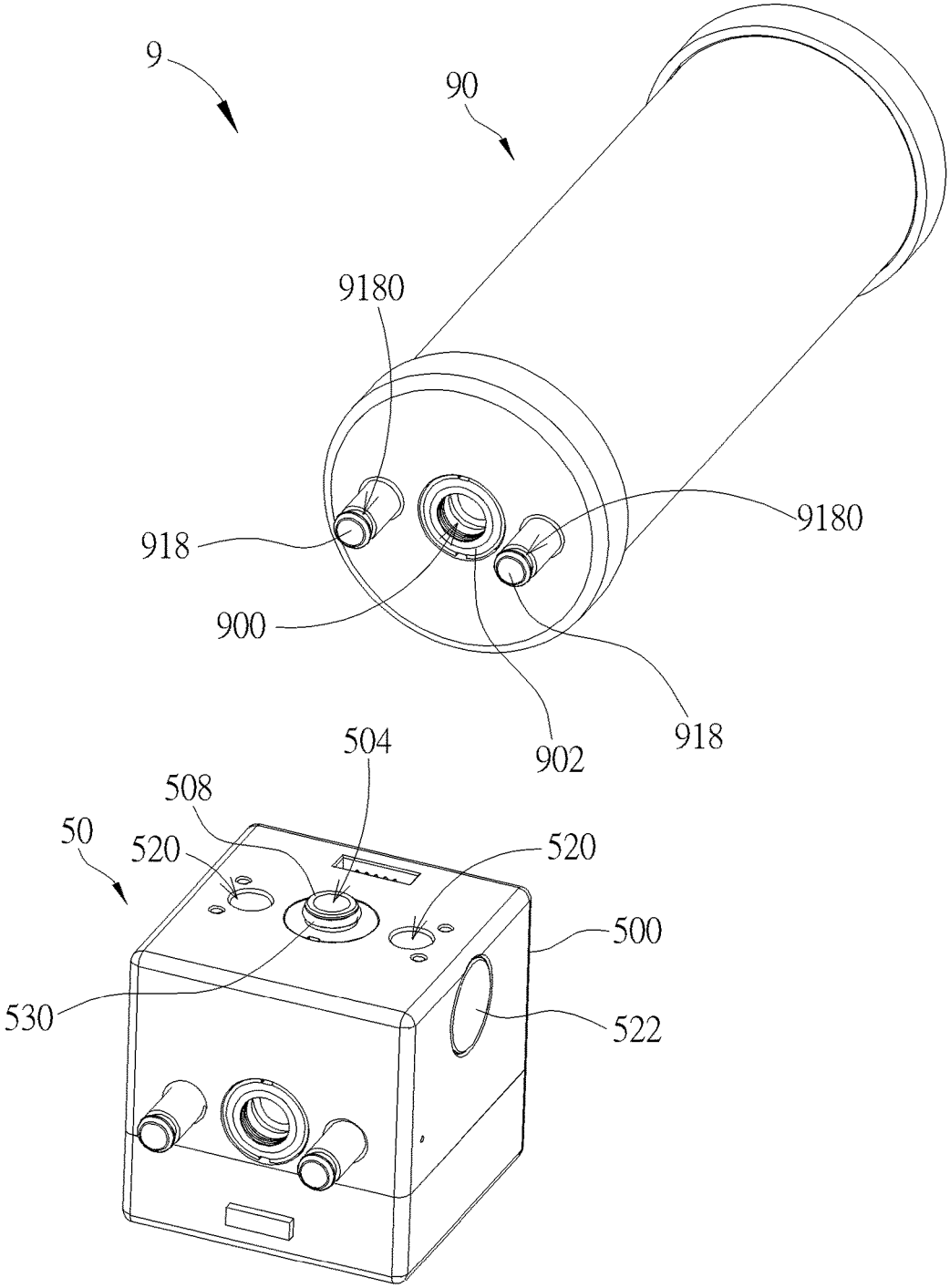
FIG. 20 is an exploded view illustrating the liquid cooling system shown in FIG. 19.
Figure 21:
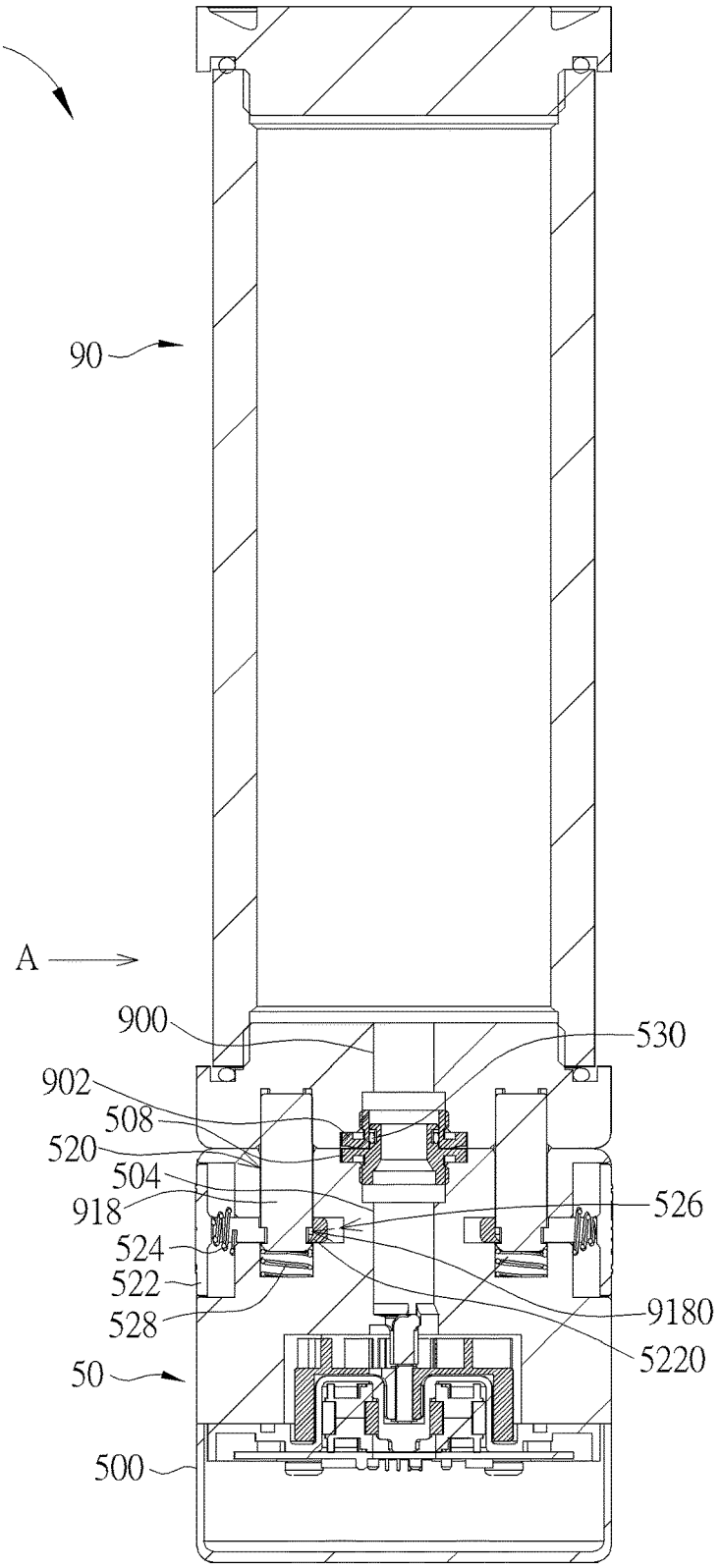
FIG. 21 is a sectional view illustrating the liquid cooling system along line W-W shown in FIG. 19.

Referring to FIGS. 19 to 21, FIG. 19 is a schematic view illustrating a liquid cooling system 9 according to another embodiment of the invention, FIG. 20 is an exploded view illustrating the liquid cooling system 9 shown in FIG. 19, and FIG. 21 is a sectional view illustrating the liquid cooling system 9 along line W-W shown in FIG. 19. As shown in FIGS. 19 to 21, the liquid cooling system 9 comprises a pump 50 and an external device 90. It should be noted that the structure of the pump 50 has been mentioned in the above, so it will not be depicted herein again. The external device 90 comprises a third opening 900 and a third connecting member 902. As shown in FIG. 20, the third connecting member 902 is disposed on the third opening 900. Accordingly, the third connecting member 902 of the external device 90 may be detachably connected to the second connecting member 508 of the pump 50, such that the external device 90 may be detachably connected to the pump 50, as shown in FIG. 19.

In this embodiment, the second opening 504 may be an outlet and the third opening 900 may be an inlet, or alternatively, the second opening 504 may be an inlet and the third opening 900 may be an outlet. Furthermore, the external device 90 may be, but not limited to, a tank for containing a cooling liquid (e.g. water, oil, and so on). Moreover, the third connecting member 902 may be a male quick connector or a female quick connector according to the type of the second connecting member 508. For example, as shown in FIG. 20, since the second connecting member 508 of the pump 50 is a male quick connector, the third connecting member 902 should be a female quick connector correspondingly.

In this embodiment, the external device 90 may further comprise a guiding pin 918. As shown in FIG. 20, the external device 90 comprises two guiding pins 918. The guiding pins 918 are disposed around the third connecting member 902. When a user wants to connect the pump 50 and the external device 90, the user may insert the guiding pins 918 of the external device 90 into the guiding holes 520 of the pump 50, so as to connect the second connecting member 508 of the pump 50 and the third connecting member 902 of the external device 90. As shown in FIG. 21, when the second connecting member 508 of the pump 50 is connected to the third connecting member 902 of the external device 90, the guiding pins 918 are inserted into the guiding holes 520 correspondingly. In other words, the guiding pins 918 and the guiding holes 520 can assist the user in connecting the pump 50 and the external device 90 rapidly and conveniently.

In this embodiment, the guiding pin 918 has an engaging groove 9180. As shown in FIG. 21, when the guiding pin 918 of the external device 90 is inserted into the guiding hole 520 of the pump 50, the engaging portion 5220 of the release button 522 is engaged with the engaging groove 9180 of the guiding pin 918. Accordingly, when the pump 50 and the external device 90 are connected to each other through the second connecting member 508 and the third connecting member 902, the pump 50 and the external device 90 will not come off each other due to the engagement formed by the engaging portion 5220 of the release button 522 and the engaging groove 9180 of the guiding pin 918. If the user wants to detach the pump 50 and the external device 90 from each other, the user may press the release button 522 in the direction indicated by an arrow A, so as to disengage the engaging portion 5220 from the engaging groove 9180 of the guiding pin 918. Once the engaging portion 5220 of the release button 522 is disengaged from the engaging groove 9180 of the guiding pin 918, the user can detach the pump 50 and the external device 90 from each other by separating the second connecting member 508 and the third connecting member 902 from each other. It should be noted that when the user presses the release button 522, the first resilient member 524 is compressed by the release button 522. When the user looses the release button 522, the first resilient member 524 generates an elastic force to push the release button 522 back.

Furthermore, when the guiding pin 918 of the external device 90 is inserted into the guiding hole 520 of the pump 50, the second resilient member 528 is compressed by the guiding pin 918. When the release button 522 is pressed to disengage the engaging portion 5220 from the engaging groove 9180 of the guiding pin 918, the second resilient member 528 generates an elastic force to push the guiding pin 918 out of the guiding hole 520. Accordingly, the user can detach the pump 50 and the external device 90 from each other much more easily.

As shown in FIG. 21, when the second connecting member 508 is connected to the third connecting member 902, the washer 530 is located between and abuts against the second connecting member 508 and the third connecting member 902, so as to prevent a working fluid (e.g. cooling liquid) from leaking out of the pump 50 and the external device 90.

As mentioned in the above, since the first opening and the second opening of each pump are equipped with the first connecting member and the second connecting member, respectively, for connecting other pumps, the invention allows a user to connect a plurality of pumps in series according to the needed flow rate. Specifically, the invention may design the first connecting member and the second connecting member to be a couple of male and female quick connectors, such that the user may attach/detach the pumps to/from each other more rapidly and conveniently. Furthermore, the invention may dispose the electrical pad on the connecting member or around the first opening/second opening, so as to save circuit layout space for the pump. Still further, the invention may dispose the sensor in the pump to sense the flow rate, the pressure and/or the temperature. Moreover, the invention may dispose the light emitting unit at the periphery of the pump to generate specific visual effect. In addition, the invention may dispose the third connecting member on the external device such as liquid cooling head, radiator, and so on and design the third connecting member to be a male quick connector or a female quick connector, such that the pump of the invention may also be attached to the external device according to practical applications, so as to form the liquid cooling system.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pump assembly comprising:

a plurality of pumps, each of the pumps comprising a pump body, a single first fluid port, a single second fluid port, a first connecting member and a second connecting member, the single first fluid port and the single second fluid port respectively located at adjacent sides of the pump body, the first connecting member being disposed on the single first fluid port, the second connecting member being disposed on the single second fluid port, the first connecting member of one of the pumps being detachably connected to the second connecting member of another of the pumps, such that each of the pumps is detachably connected to any of the other pumps.

2. The pump assembly of claim 1, wherein one of the first connecting member and the second connecting member is a male quick connector and the other one of the first connecting member and the second connecting member is a female quick connector.

3. The pump assembly of claim 1, wherein the pump body of each of the pumps is regular polygonal.

4. The pump assembly of claim 1, wherein each of the pumps further comprises a first electrical pad and a second electrical pad, the first electrical pad is selectively disposed on the first connecting member or around the single first fluid port, the second electrical pad is corresponding to the first electrical pad and selectively disposed on the second connecting member or around the single second fluid port, the first electrical pad is electrically connected to the second electrical pad when the first connecting member is connected to the second connecting member.

5. The pump assembly of claim 4, wherein the first electrical pad and the second electrical pad are circular.

6. The pump assembly of claim 4, wherein each of the pumps further comprises a circuit board and a power connector, the circuit board and the power connector are disposed in the pump body, the power connector, the first electrical pad and the second electrical pad are electrically connected to the circuit board.

7. The pump assembly of claim 1, wherein each of the pumps further comprises a sensor for sensing a flow rate, a pressure and/or a temperature of a working fluid in the pump.

8. The pump assembly of claim 1, wherein each of the pumps further comprises a light emitting unit disposed at the periphery of the pump body.

9. The pump assembly of claim 1, wherein each of the pumps further comprises a guiding pin and a guiding hole, wherein the guiding pin and the guiding hole are respectively located at different sides of the pump body and the guiding pin of one of the pump bodies is inserted into the guiding hole of another one of the pump bodies when the first connecting member is connected to the second connecting member.

10. The pump assembly of claim 9, wherein each of the pumps further comprises a release button and a first resilient member, the release button is movably embedded into the pump body, the first resilient member is located between and abutting the release button and the pump body, the release button has an engaging portion, the engaging portion has a through hole communicating with the guiding hole and for the insertion of the guiding pin, the engaging portion of the release button of one of the pump bodies is inserted into the through hole of the guiding pin of another one of the pump bodies when the guiding pin is inserted into the guiding hole and disposed through the through hole of the engaging portion.

11. The pump assembly of claim 10, wherein each of the pumps further comprises a second resilient member disposed in the guiding hole, the second resilient member of one of the pump bodies is compressed by the guiding pin when the guiding pin of another one of the pump bodies is inserted into the guiding hole, the second resilient member generates an elastic force to push the guiding pin out of the guiding hole when the release button is pressed to disengage the engaging portion from the engaging groove.

12. The pump assembly of claim 1, wherein each of the pumps further comprises a rotating member rotatably disposed on the pump body, the rotating member has an engaging portion, a recess is formed on the pump body, the recess has an engaging groove, a part of the rotating member is accommodated in the recess when the first connecting member is connected to the second connecting member, the rotating member is capable of being rotated to enable the engaging portion to be engaged with or disengaged from the engaging groove when the part of the rotating member is accommodated in the recess.

13. The pump assembly of claim 1, wherein each of the pumps further comprises a washer selectively disposed on one of the first connecting member and the second connecting member, the washer located between and abutting-the first connecting member and the second connecting member when the first connecting member is connected to the second connecting member.

14. A pump assembly comprising a plurality of pumps, each of the pumps comprising:

a pump body;

a single first fluid opening;

a single second fluid opening;

a first connecting member disposed on the single first fluid opening; and a second connecting member disposed on the single second fluid opening;

wherein the single first fluid opening and the single second fluid opening are respectively located at adjacent sides of the pump body; and wherein the first connecting member of one of the pumps is detachably connected to the second connecting member of another of the pumps, such that each of the pumps is detachably connected to one or more of the other pumps.

15. The pump assembly of claim 14, wherein one of the first connecting member and the second connecting member is a male quick connector and the other one of the first connecting member and the second connecting member is a female quick connector.

16. The pump assembly of claim 14, wherein the pump body of each of the pumps is regular polygonal.

17. The pump assembly of claim 14, each of the pumps further comprising a first electrical pad and a second electrical pad, the first electrical pad being selectively disposed on the first connecting member or around the single first fluid opening, the second electrical pad being corresponding to the first electrical pad and selectively disposed on the second connecting member or around the single second fluid opening.

18. The pump assembly of claim 17, wherein the first electrical pad and the second electrical pad are circular.

19. The pump assembly of claim 17, each of the pumps further comprising a circuit board and a power connector, the circuit board and the power connector being disposed in the pump body, the power connector, the first electrical pad and the second electrical pad being electrically connected to the circuit board.

20. The pump assembly of claim 14, each of the pumps further comprising a sensor for sensing a flow rate, a pressure and/or a temperature of a working fluid in the pump.

21. The pump assembly of claim 14, each of the pumps further comprising a light emitting unit disposed at the periphery of the pump body.

22. The pump assembly of claim 14, each of the pumps further comprising a guiding pin and a guiding hole, wherein the guiding pin and the guiding hole are respectively located at different sides of the pump body.

23. The pump assembly of claim 22, each of the pumps further comprising a release button and a first resilient member, the release button being movably embedded into the pump body, the first resilient member being located between and abutting the release button and the pump body, the release button having an engaging portion, the engaging portion having a through hole communicating with the guiding hole, the engaging portion of the release button of one of the pump bodies being inserted into the through hole of the guiding pin of another one of the pump bodies when the guiding pin is inserted into the guiding hole and disposed through the through hole of the engaging portion.

24. The pump assembly of claim 23, each of the pumps further comprising a second resilient member disposed in the guiding hole.

25. The pump assembly of claim 14, each of the pumps further comprising a rotating member rotatably disposed on the pump body, the rotating member having an engaging portion, a recess being formed on the pump body, the recess having an engaging groove.

26. The pump assembly of claim 14, each of the pumps further comprising a washer selectively disposed on one of the first connecting member and the second connecting member.

* * * * *